US011565868B1

(12) United States Patent
Naweed

(10) Patent No.: US 11,565,868 B1
(45) Date of Patent: Jan. 31, 2023

(54) READY TO MIX AND DRINK COCKTAIL BOTTLE

(71) Applicant: Mohammad Ali Naweed, Lahore (PK)

(72) Inventor: Mohammad Ali Naweed, Lahore (PK)

( * ) Notice: Subject to any disclaimer, the term of this patent is extended or adjusted under 35 U.S.C. 154(b) by 0 days.

(21) Appl. No.: 17/943,985

(22) Filed: Sep. 13, 2022

Related U.S. Application Data

(63) Continuation-in-part of application No. 17/675,037, filed on Feb. 18, 2022, and a continuation-in-part of application No. 29/816,413, filed on Nov. 22, 2021, said application No. 17/675,037 is a continuation-in-part of application No. 29/810,495, filed on Oct. 5, 2021.

(60) Provisional application No. 63/239,591, filed on Sep. 1, 2021.

(51) Int. Cl.
*B65D 81/32* (2006.01)

(52) U.S. Cl.
CPC ..... *B65D 81/3211* (2013.01); *B65D 2401/50* (2020.05)

(58) Field of Classification Search
CPC ..... B65D 81/3211; B65D 81/3205; B65D 81/32; B65D 2401/50; A47J 43/27; A61J 1/2031
USPC ..... 206/221, 219
See application file for complete search history.

(56) References Cited

U.S. PATENT DOCUMENTS 6,068,396 A * 5/2000 Baudin ..... B65D 25/085 215/DIG. 8
7,413,074 B2 8/2008 Barr
9,708,109 B2 7/2017 Marina
2007/0221601 A1* 9/2007 Eitrheim ..... A61J 11/002 215/6
2008/0142030 A1* 6/2008 Venere ..... A45D 19/012 222/129
2009/0178940 A1* 7/2009 Said ..... A61J 9/00 215/11.1
2011/0266247 A1 11/2011 Littrell
2013/0037506 A1* 2/2013 Wahlstrom ..... A61J 1/2093 215/6
2017/0101252 A1* 4/2017 Acott ..... A47J 31/407
2018/0168930 A1* 6/2018 Tunesi ..... A61J 1/18
2018/0238727 A1* 8/2018 Wong ..... G01F 11/36
2019/0009969 A1* 1/2019 Kite ..... B65D 81/3211
(Continued)

FOREIGN PATENT DOCUMENTS

JP 2007532416 A 11/2007

*Primary Examiner* — Steven A. Reynolds

(57) ABSTRACT

A ready to mix and drink cocktail bottle is an apparatus that enables a user to selectively mix fresh ingredients with a liquid base to make a desired beverage on the go. The apparatus includes a container body and a mixing mechanism. The container body serves to retain an amount of liquid base to make the desired beverage. The container body also serves to retain the mixed beverage after mixing and to facilitate the consumption of the mixed beverage. The mixing mechanism serves to retain the several beverage ingredients separate from each other until mixing. The mixing mechanism retains the several beverage ingredients in such a way that the freshness of each of the beverage ingredients is preserved. The mixing mechanism also facilitates the mixing of the beverage ingredients with the amount of liquid base retained in the container body when the user is ready to consume the mixed beverage.

20 Claims, 26 Drawing Sheets

(56) References Cited

U.S. PATENT DOCUMENTS

2019/0307227 A1* 10/2019 Pardo ..... A61K 8/671
2020/0391928 A1* 12/2020 Willis ..... B65D 47/242

* cited by examiner

READY TO MIX AND DRINK COCKTAIL BOTTLE

FIELD OF THE INVENTION

The present invention relates generally to means for making on-the-go cocktails. More specifically, the present invention provides a novel container with integrated means to enable the straining and the mixing of multiple liquids with different viscosities to create a single drinkable beverage.

BACKGROUND OF THE INVENTION

Nowadays, beverages are provided in different configurations for the ease of consumption. Many beverages are sold premixed for quick and easy consumption by the consumer. However, some beverages still require manual mixing before consumption, such as cocktails. Cocktails in general involve the preparation and mixing of different ingredients including, but not limited to, alcoholic beverages, garnishes, and other soft drinks. There are several recipes for cocktails that involve different ingredients and tools, which can make it difficult for the casual drinker to master if they want to make a cocktail without the aid of a professional or a recipe. Further, preparing and gathering the tools necessary to make a proper cocktail can be time consuming, which can also deter the casual drinker from making a cocktail on their own. Furthermore, cocktails are often a staple of social gatherings and entertainment venues. However, many times attendees often find it difficult to promptly receive their drinks due to the high volume of attendees at the event. In addition, due to the increasing risk of drink spiking, many are often distrustful of the drinks being served at these venues.

Therefore, an objective of the present invention is to provide a novel beverage container with integrated means to enable a user to strain and mix multiple beverage ingredients with different viscosities to create a single drinkable beverage. The present invention includes an integrated mechanism that enables the mixing of several ingredients internally without opening or manually pouring the ingredients out to make a cocktail on the go. Another objective of the present invention is to provide a novel beverage container that enables the storage of fresh ingredients separate from each other within the same container. The present invention enables the consumer to keep fresh ingredients separate until the user wants to mix the ingredients. Another objective of the present invention is to provide a novel beverage container that can be restocked for future use. Additional features and benefits of the present invention are further discussed in the sections below.

SUMMARY OF THE INVENTION

The present invention is a ready to mix and drink cocktail bottle that enables the user to strain and mix several ingredients that are internally held inside the present invention to make cocktails on the go. More specifically, the present invention provides novel containers with integrated means to enable the straining and the mixing of multiple beverage ingredients with different viscosities to create a single drinkable beverage, such as a cocktail, on the go. The present invention also eliminates the preparation of the ingredients by providing fresh ingredients along with the base drink necessary to make the desired alcoholic beverage in a single container. To do so, the present invention includes a structure designed to retain a liquid base, such as an alcoholic beverage or soft drinks, along with several ingredients that can be mixed with the liquid base. The ingredients are stored separate from each other within the same structure to maintain all the ingredients fresh until the ingredients are mixed with the liquid base. Further, the present invention also includes means to control when the ingredients are mixed with the liquid base. In addition, the present invention includes means to thoroughly mix and strain the ingredients to make the desired beverage. Thus, the present invention serves as a to-go beverage product that can be quickly mixed whenever the user wants to consume the beverage without compromising the freshness of the ingredients or the taste of the beverage.

DETAIL DESCRIPTIONS OF THE INVENTION

Figure 1:
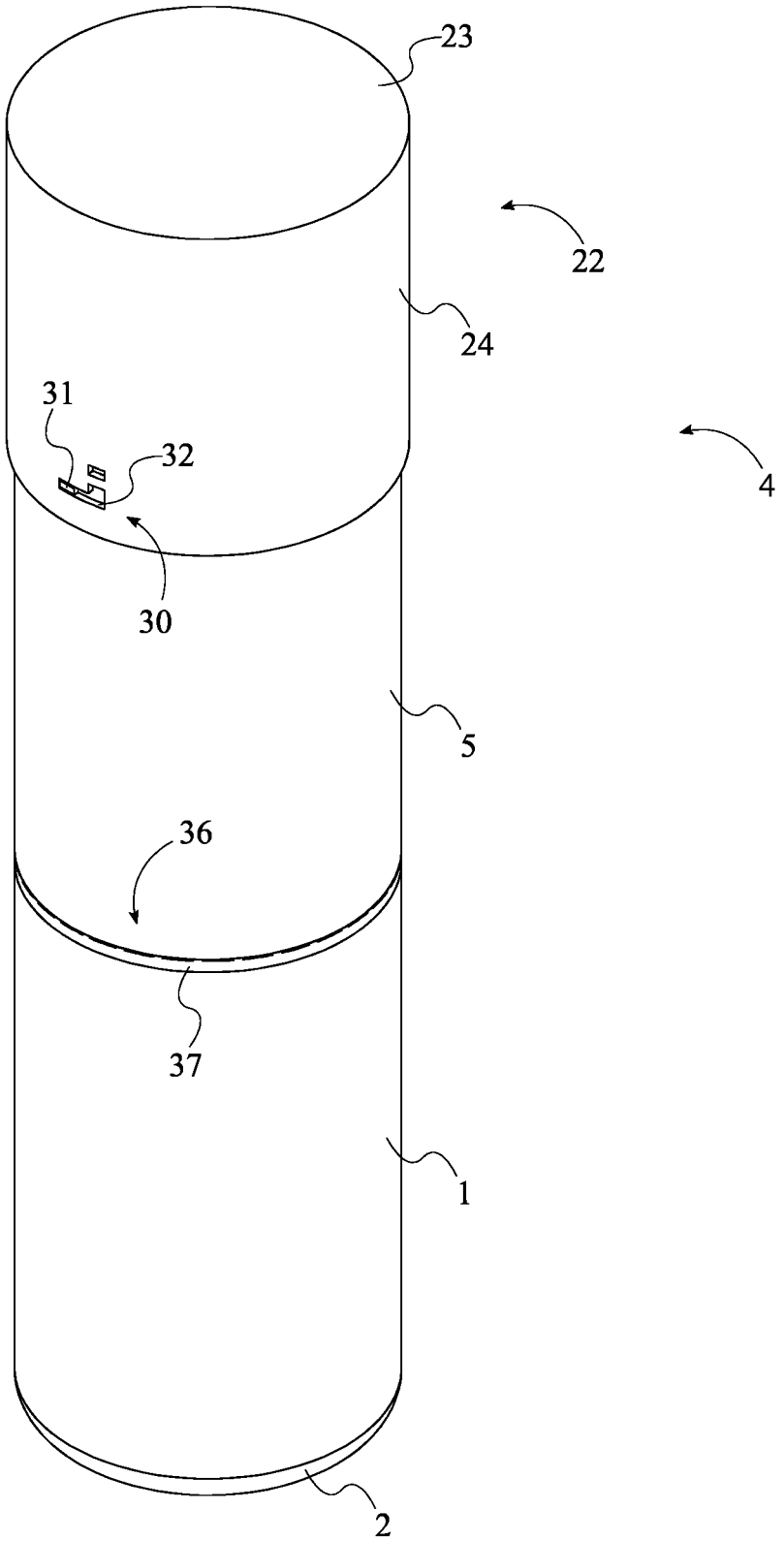
FIG. 1 is a top-front perspective view showing the present invention.
Figure 2:
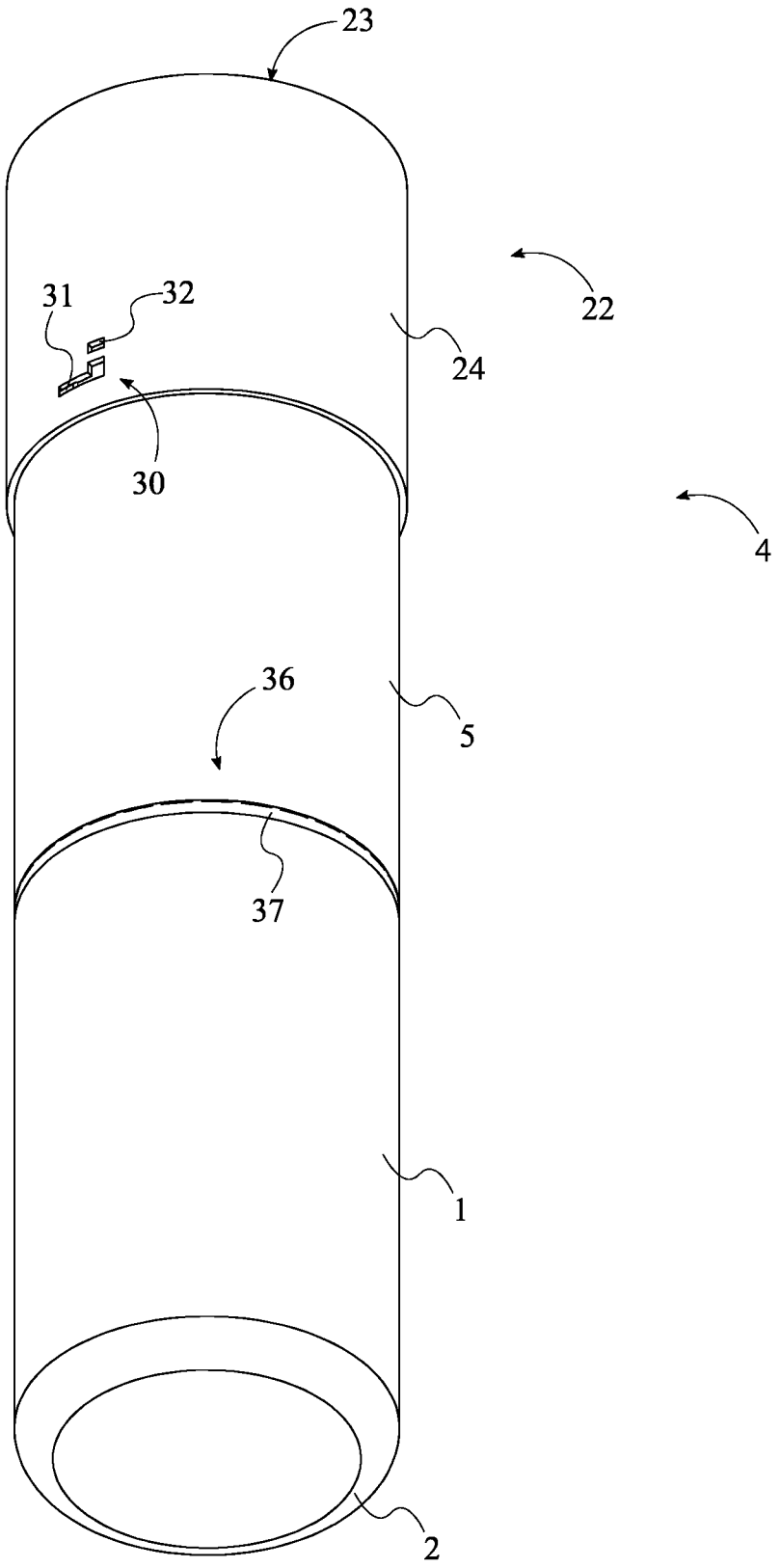
FIG. 2 is a bottom-rear perspective view showing the present invention.
Figure 3:
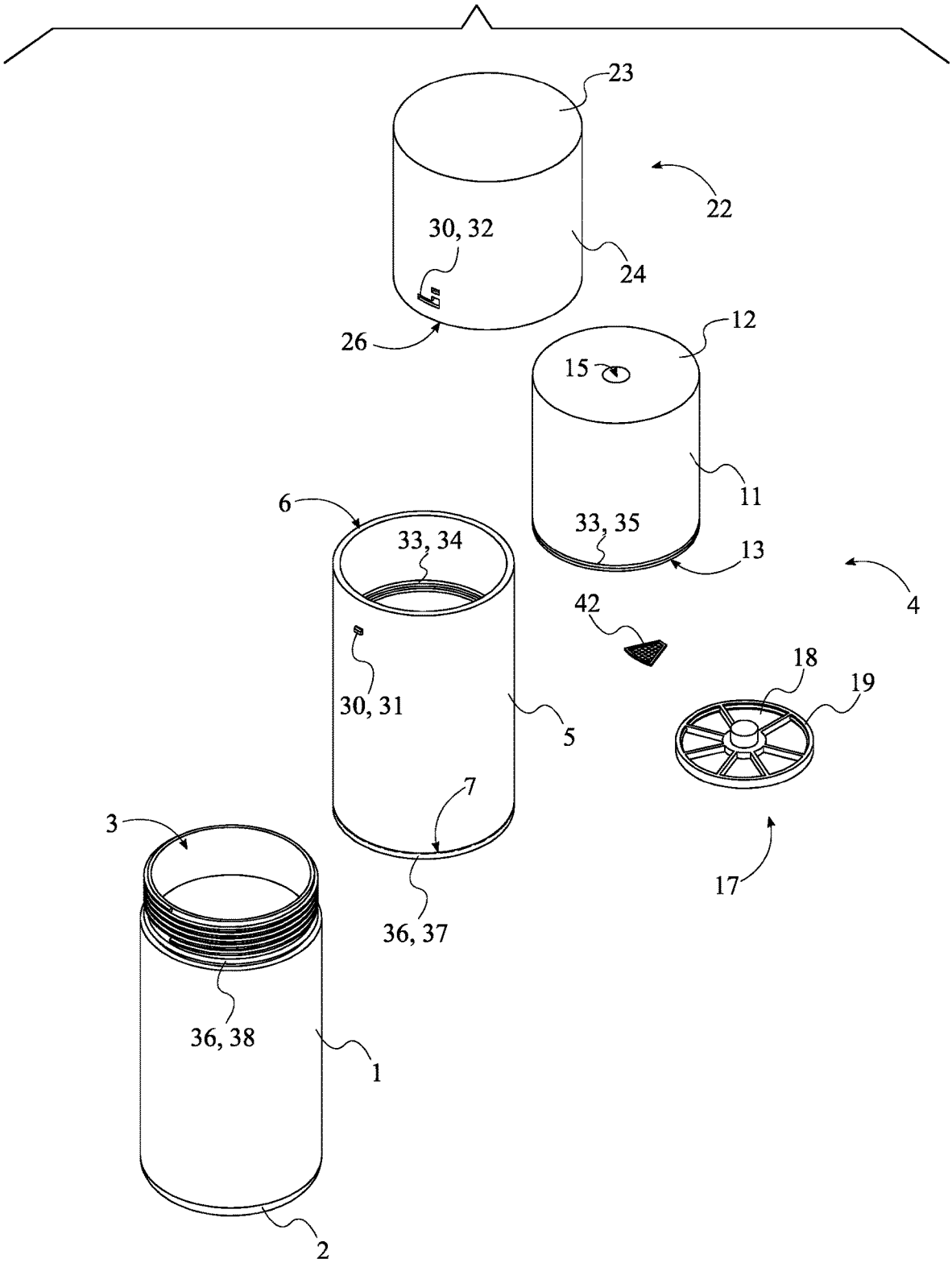
FIG. 3 is a top-front exploded perspective view showing the present invention.
Figure 4:
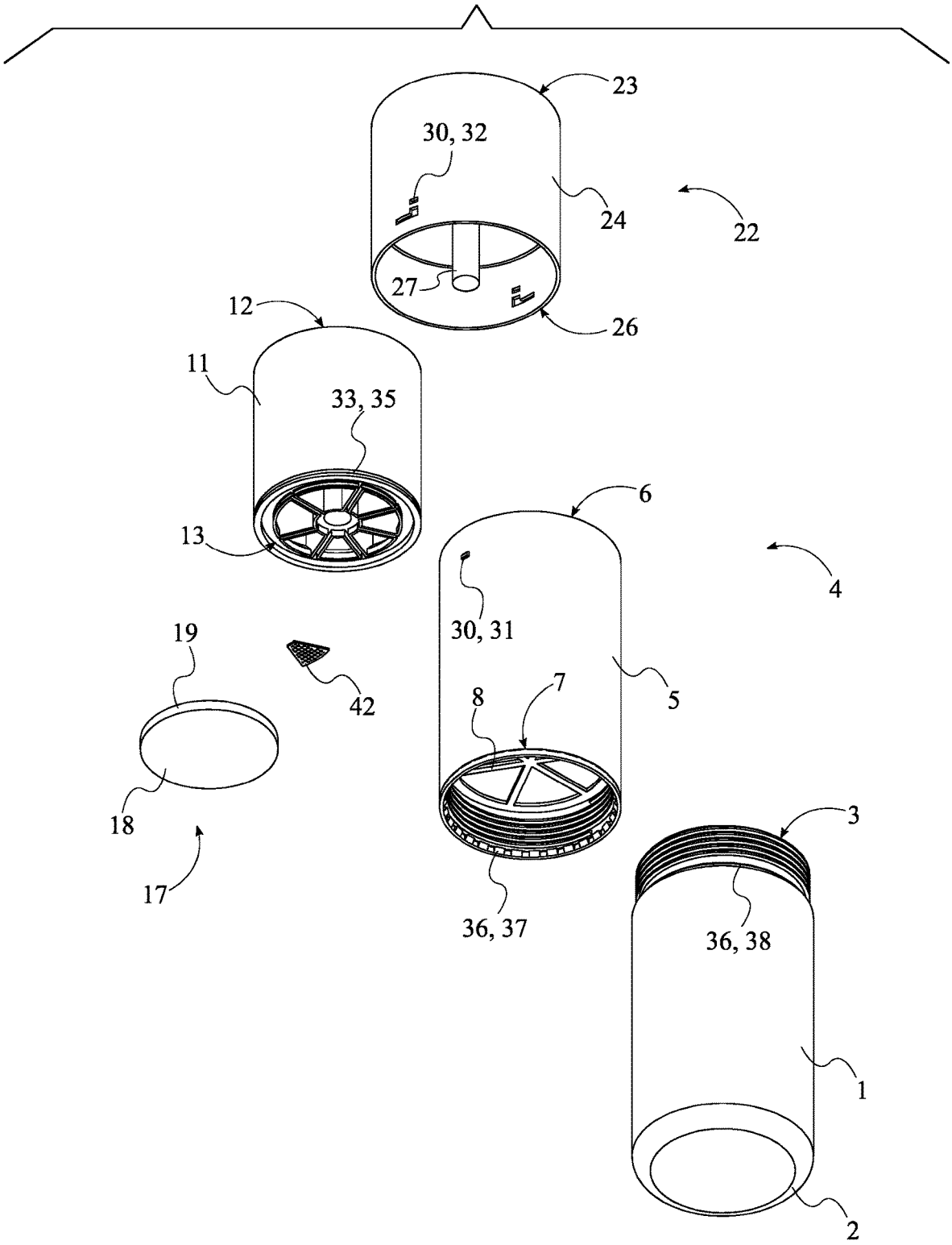
FIG. 4 is a bottom-rear exploded perspective view showing the present invention.
Figure 5:
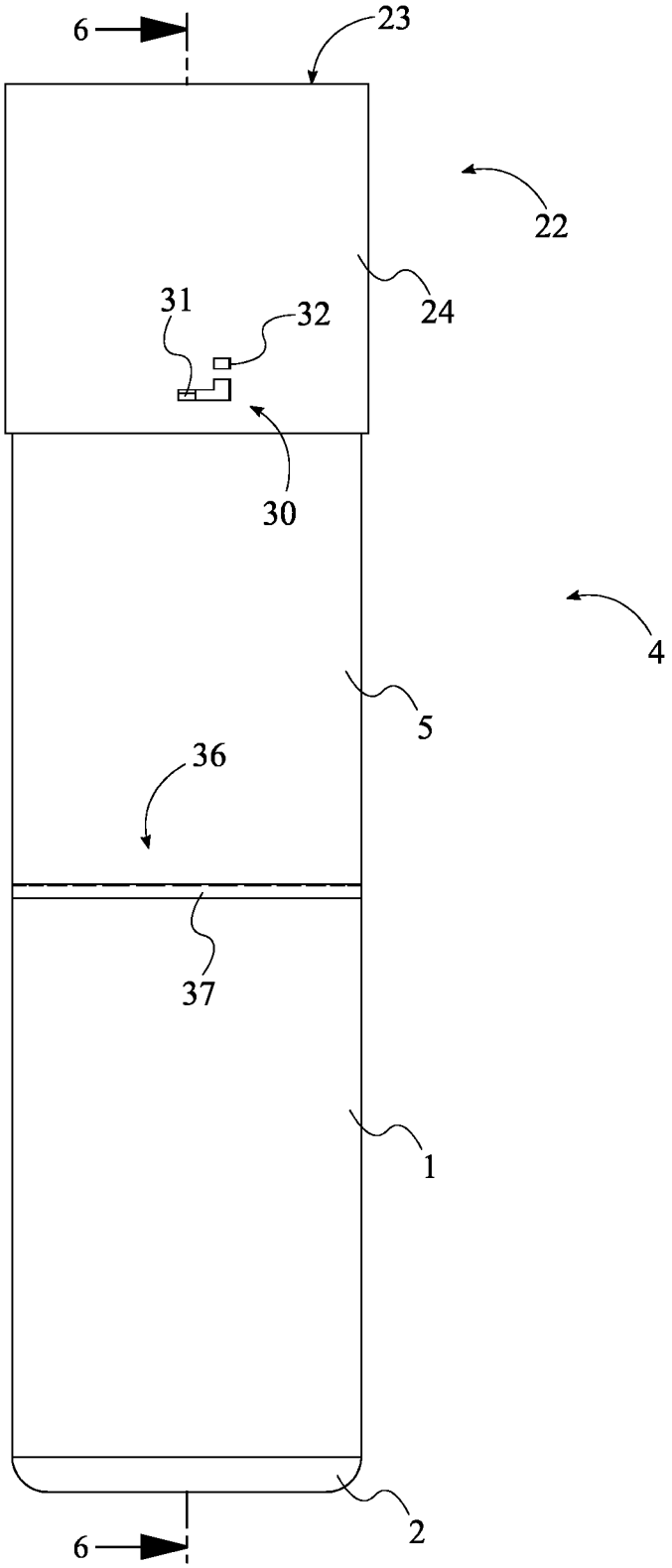
FIG. 5 is a front view showing the present invention, wherein the present invention is shown in a first configuration.
Figure 6:
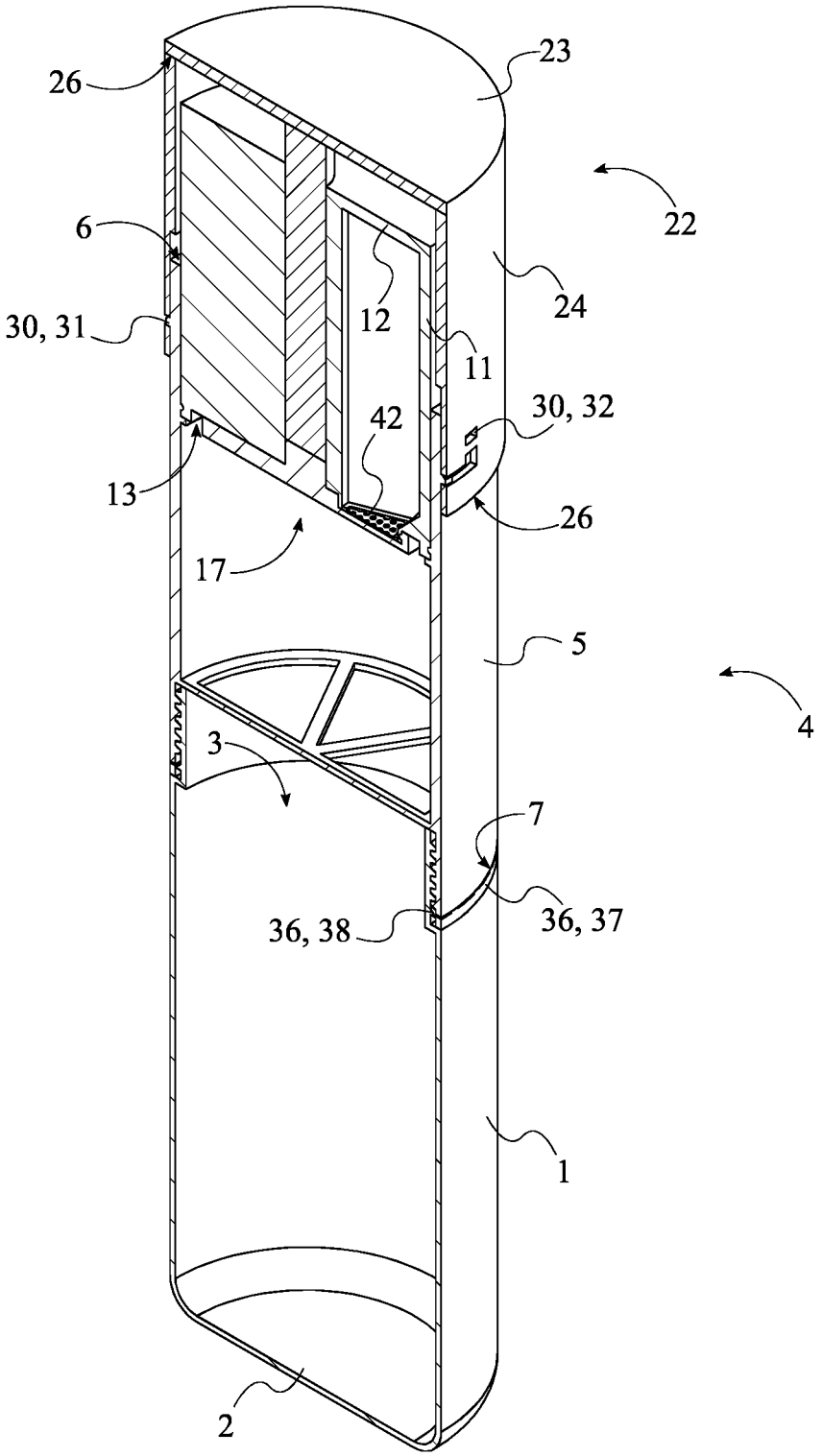
FIG. 6 is a cross-sectional perspective view taken in the direction of line 6-6 in FIG. 5.
Figure 7:
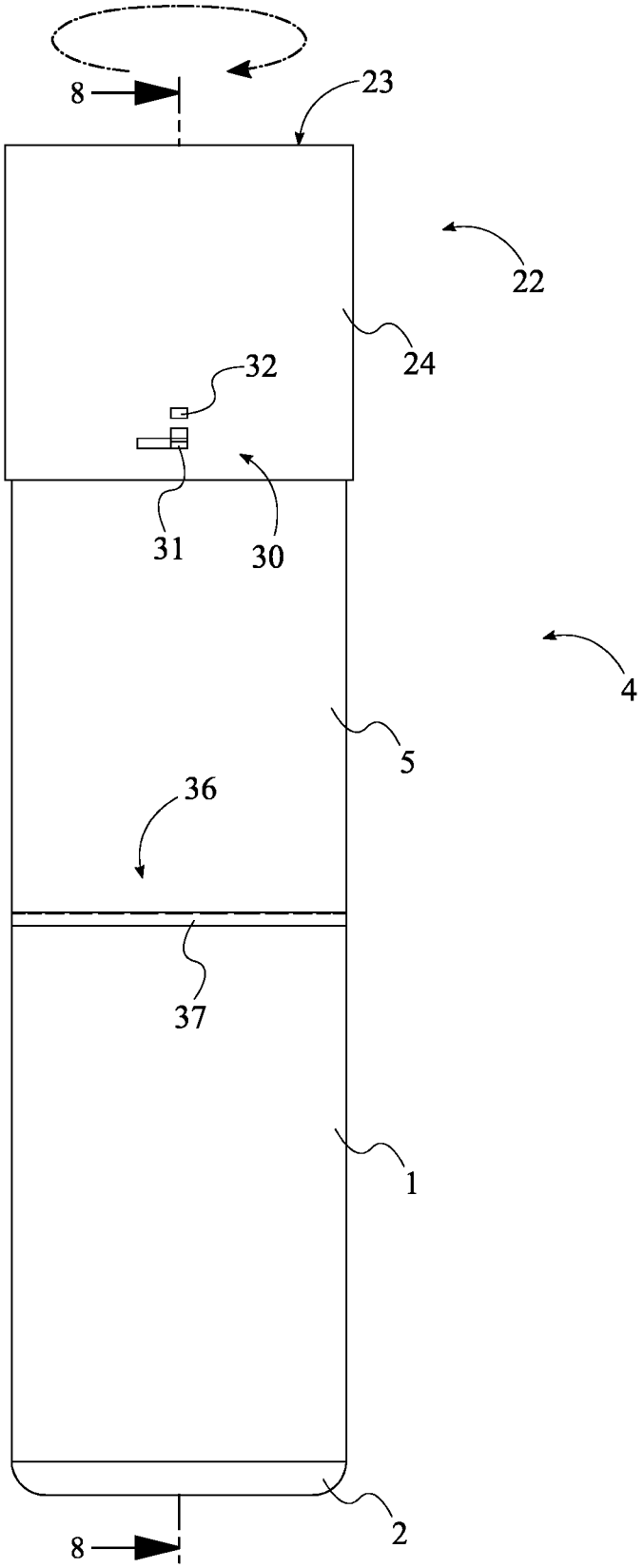
FIG. 7 is a front view showing the present invention, wherein the present invention is shown in a second configuration.
Figure 8:
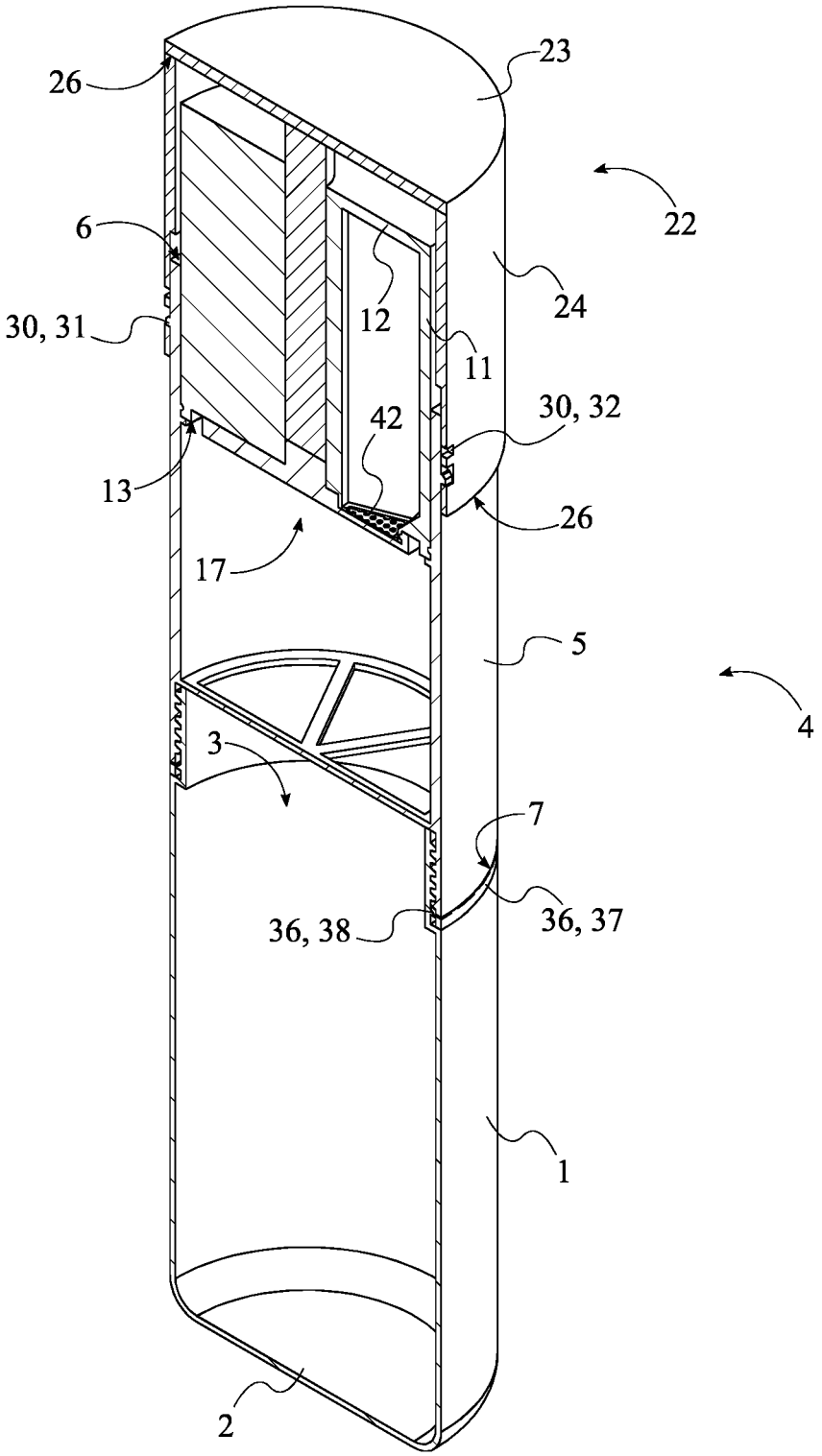
FIG. 8 is a cross-sectional perspective view taken in the direction of line 8-8 in FIG. 7.
Figure 9:
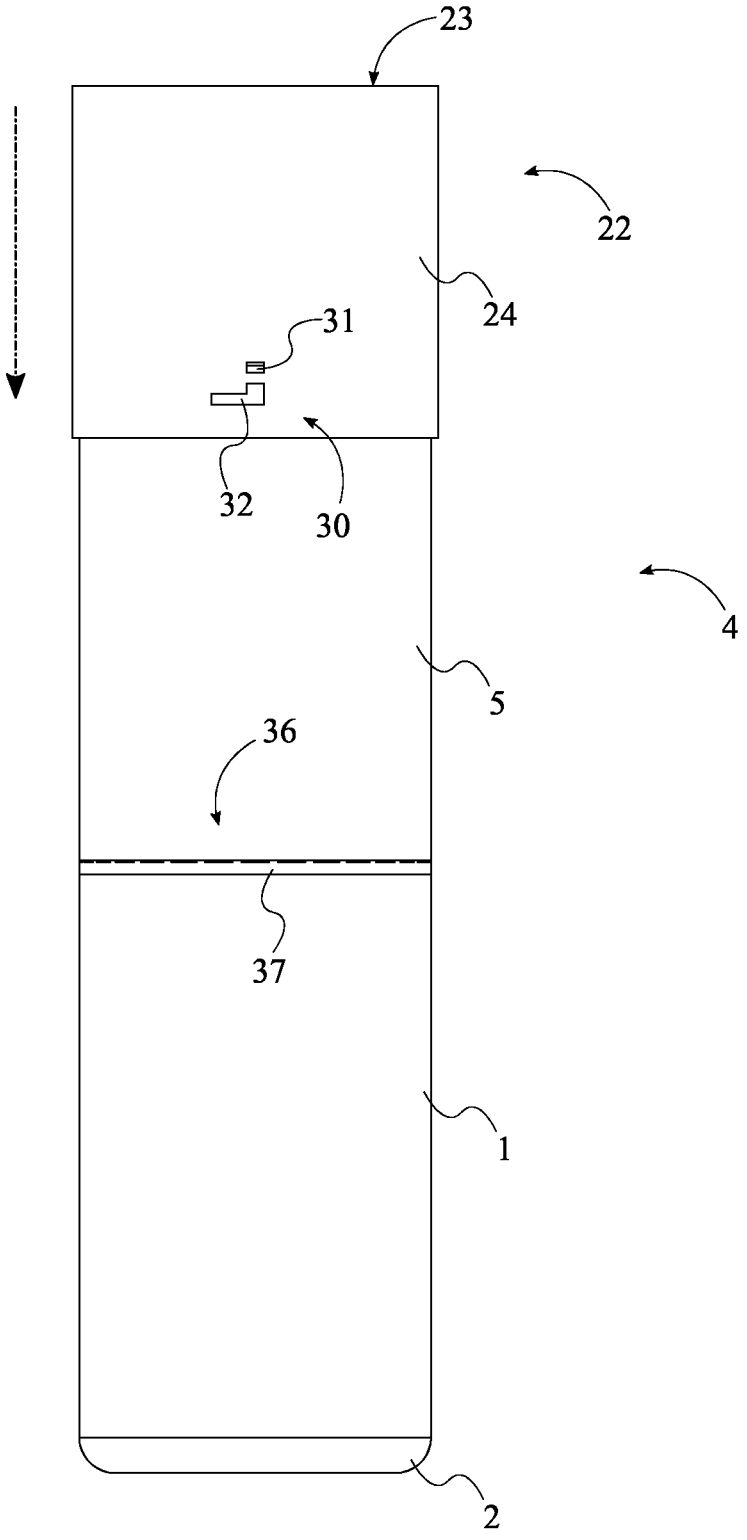
FIG. 9 is a front view showing the present invention, wherein the present invention is shown in a third configuration.
Figure 10:
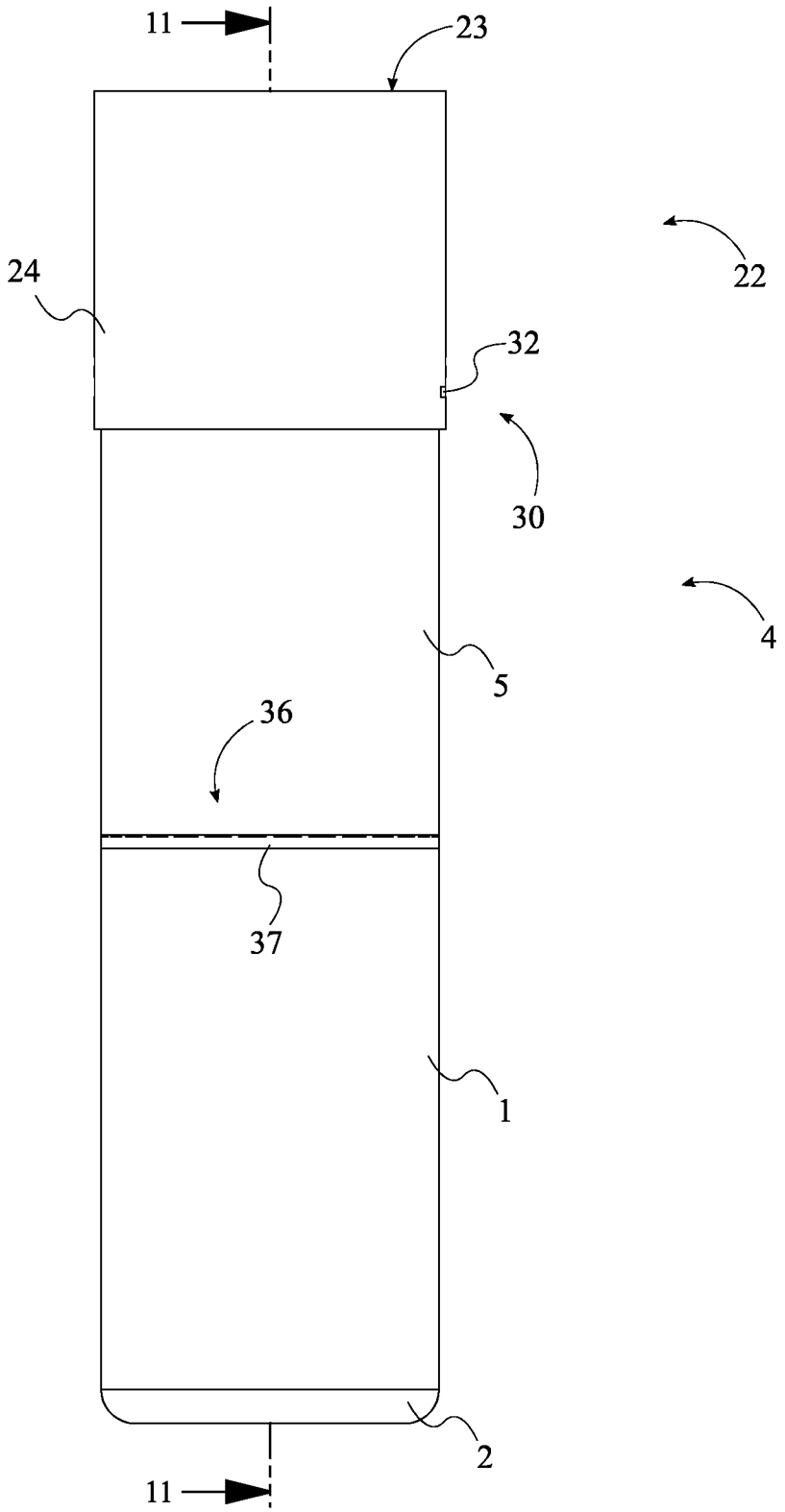
FIG. 10 is a side view showing the present invention, wherein the present invention is shown in the third configuration.
Figure 11:
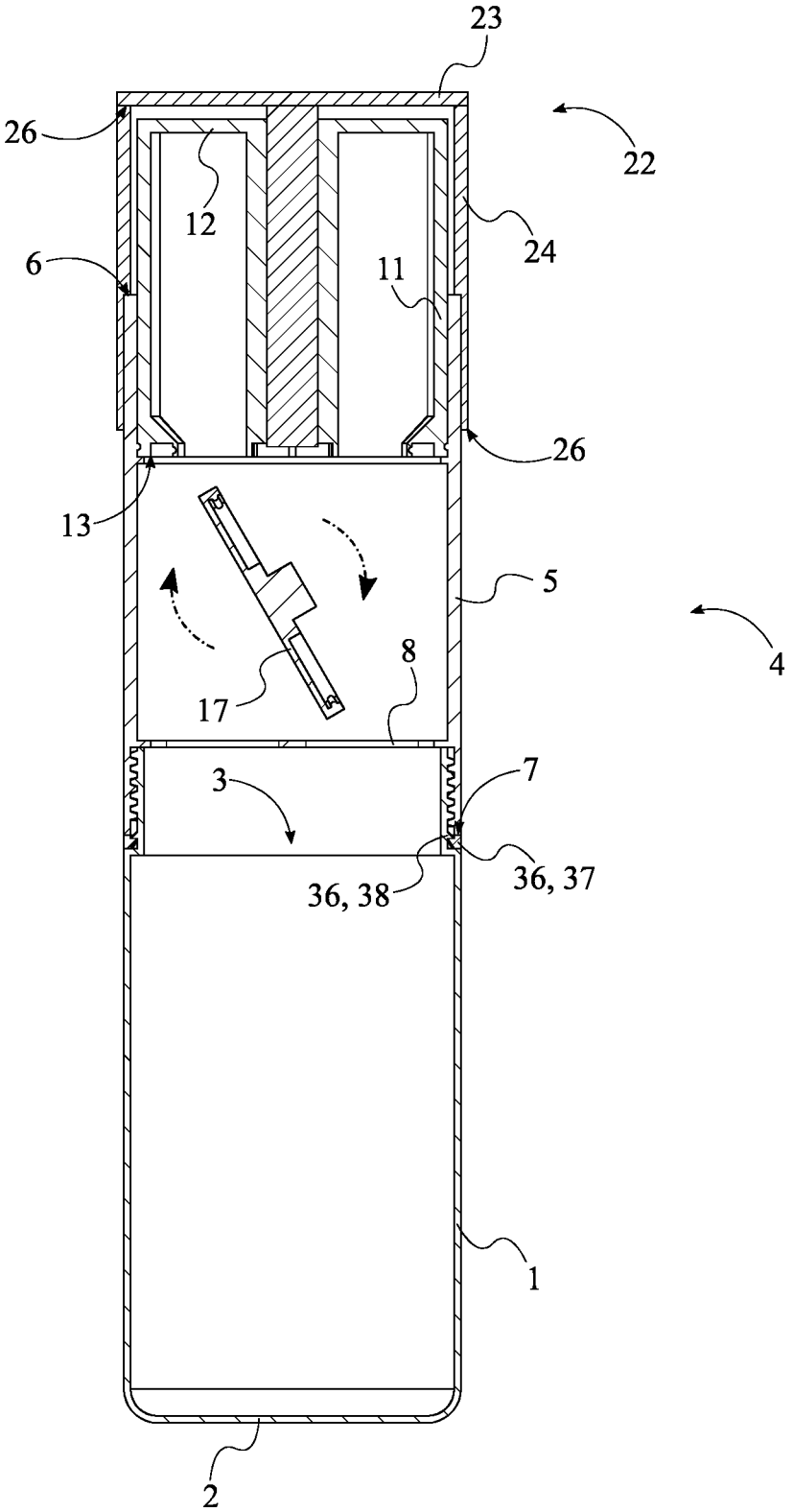
FIG. 11 is a vertical cross-sectional view taken in the direction of line 11-11 in FIG. 10.
Figure 12:
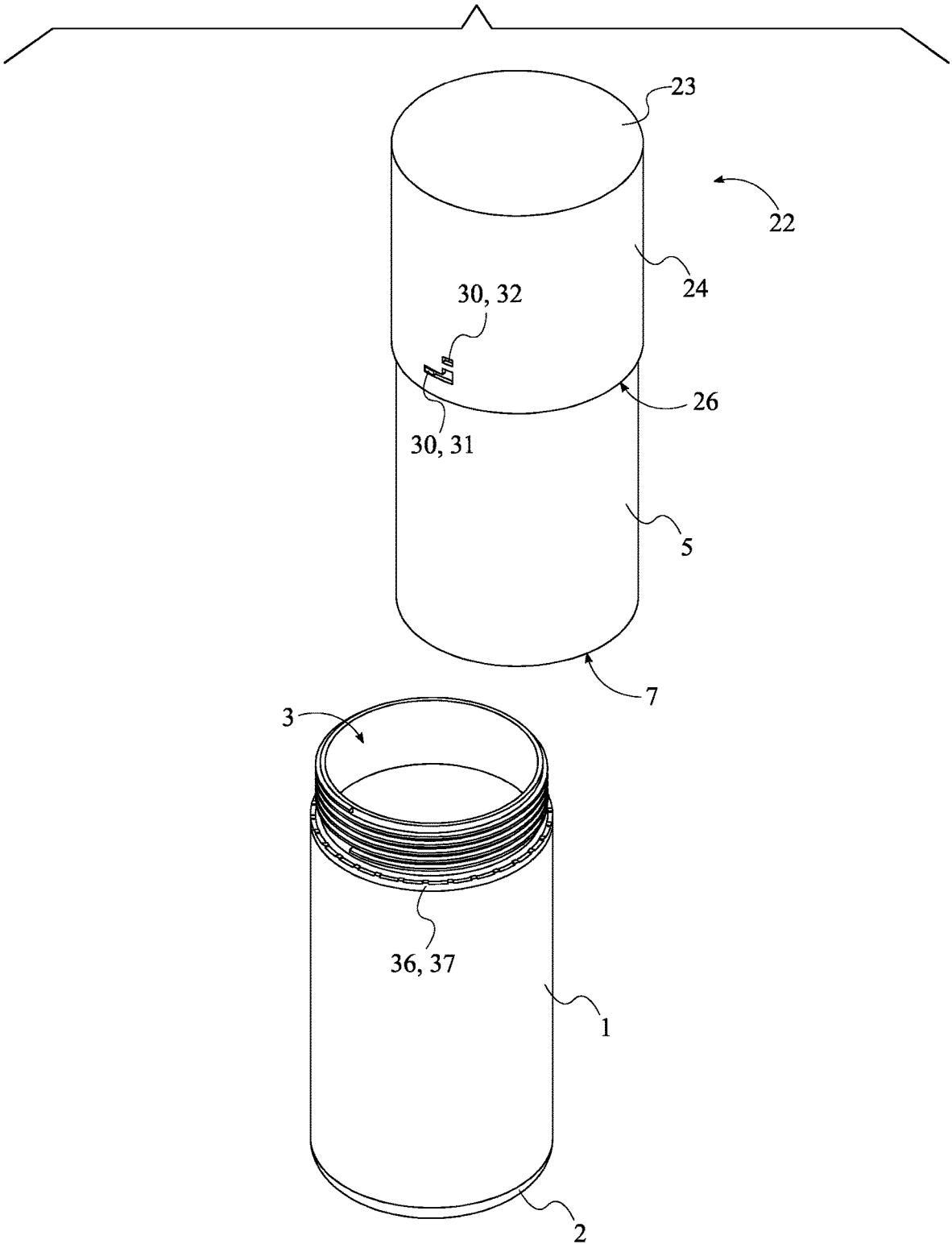
FIG. 12 is a top-front exploded perspective view showing the present invention, wherein the tamper-evident mechanism is shown broken after the container body has been removed from the mixing body.
Figure 13:
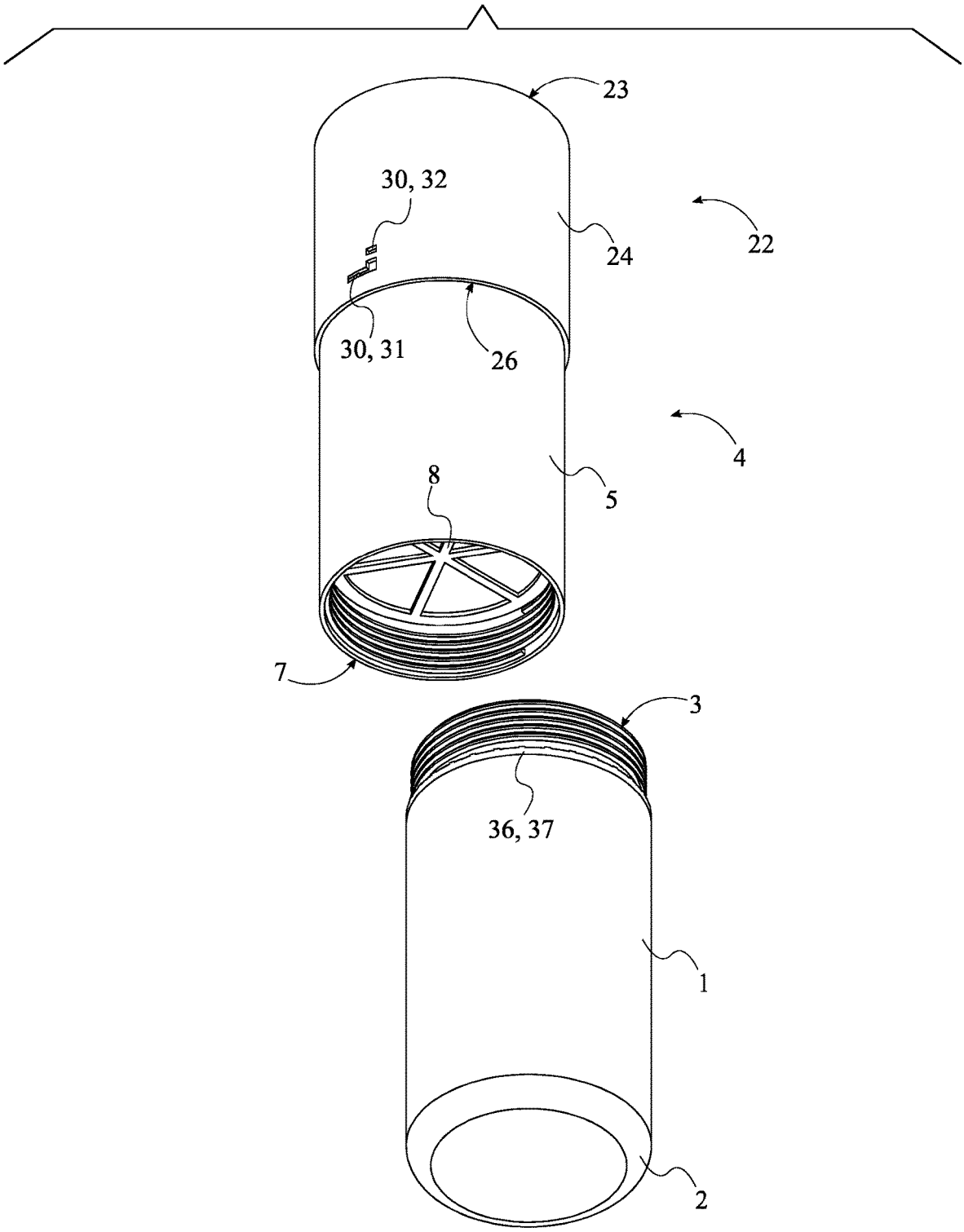
FIG. 13 is a bottom-rear exploded perspective view showing the present invention, wherein the tamper-evident mechanism is shown broken after the container body has been removed from the mixing body.
Figure 14:
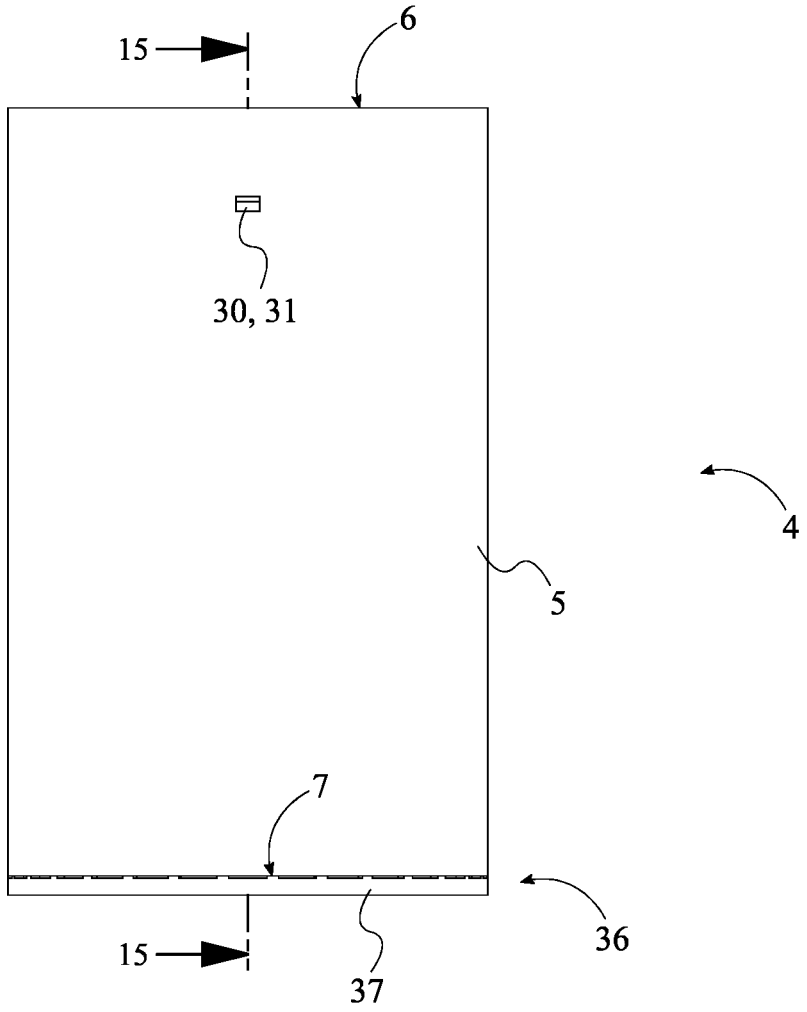
FIG. 14 is a front view showing the mixing body of the present invention.
Figure 15:
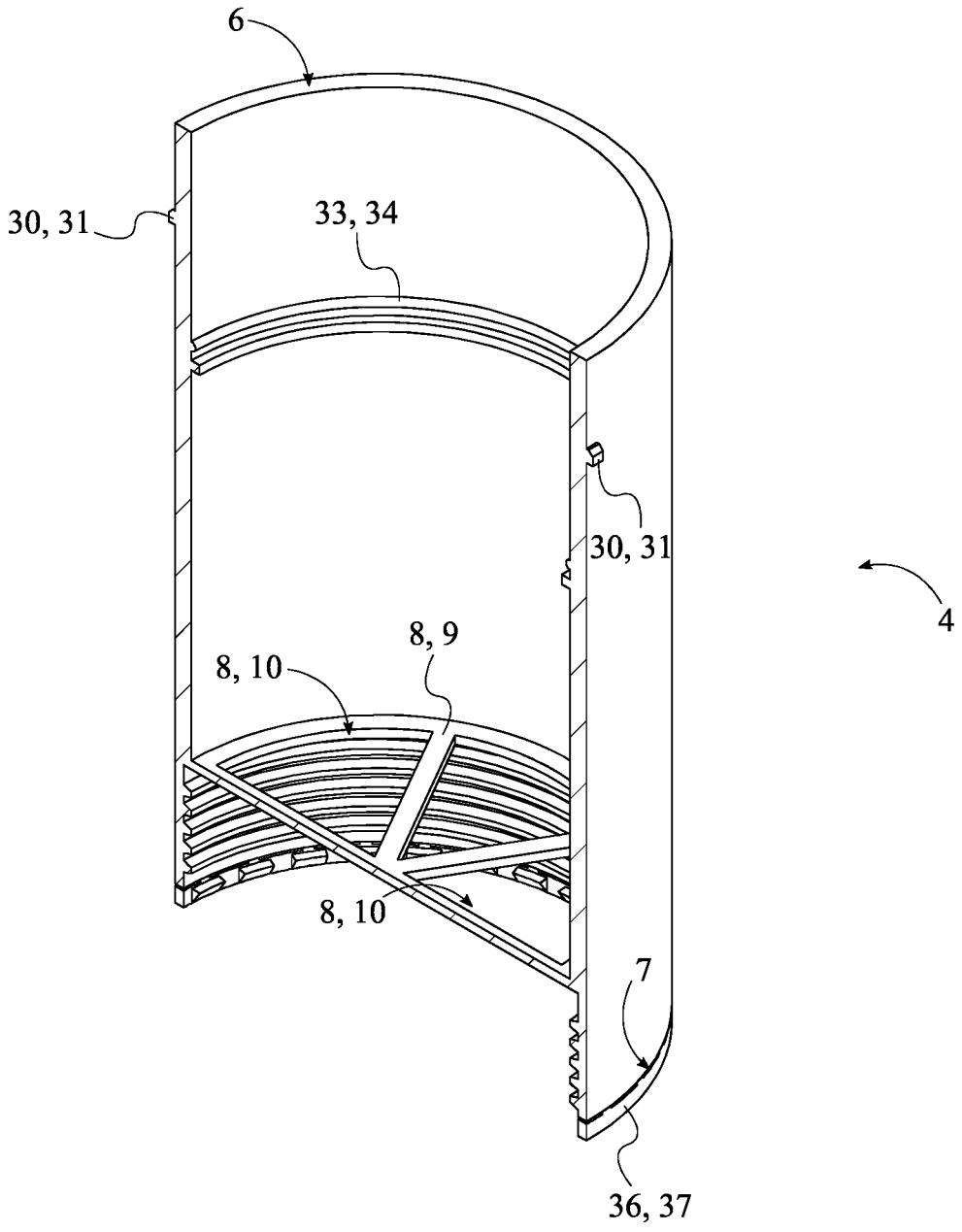
FIG. 15 is a cross-sectional perspective view taken in the direction of line 15-15 in FIG. 14.
Figure 16:
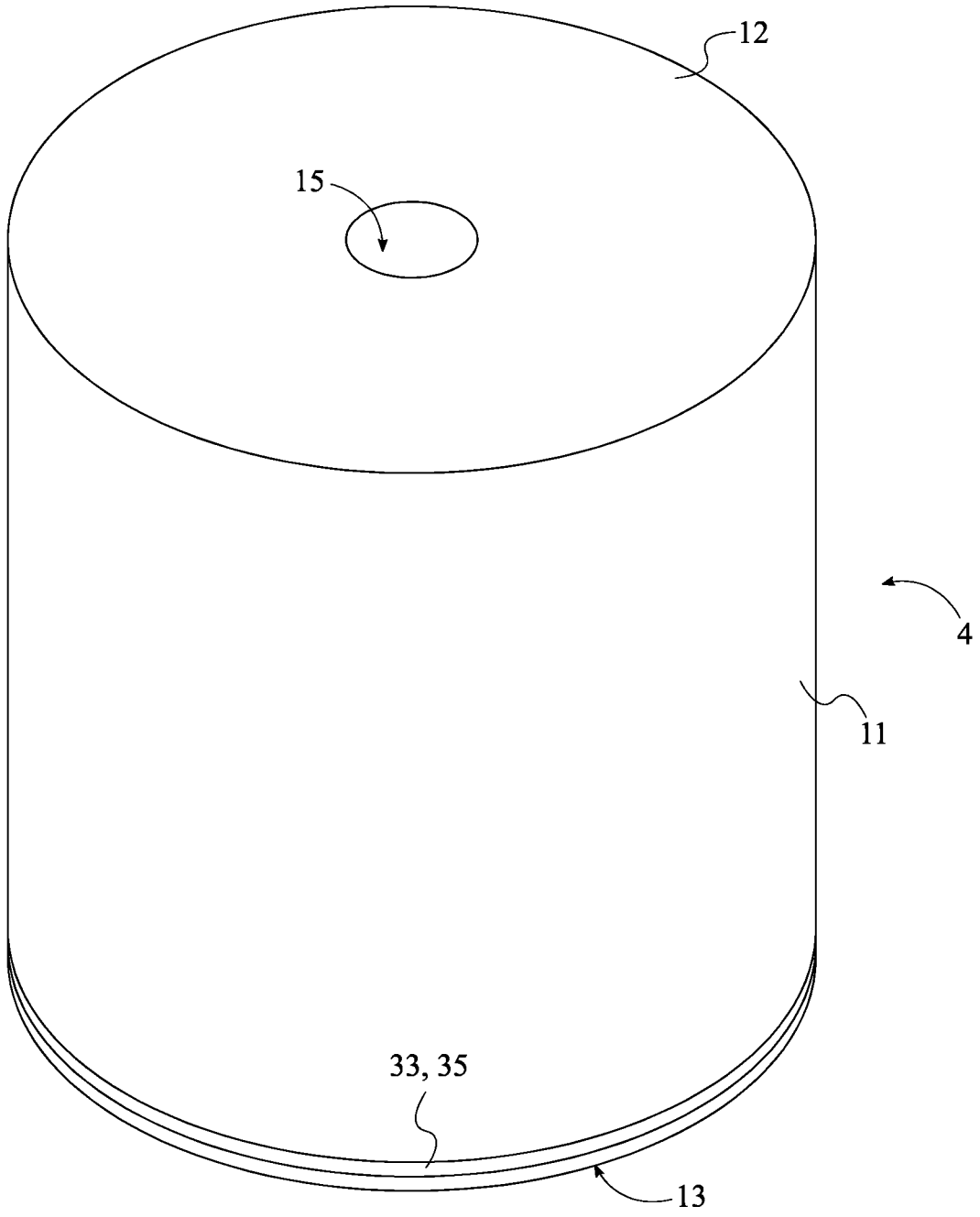
FIG. 16 is a top-front perspective view showing the holder body of the present invention.
Figure 17:
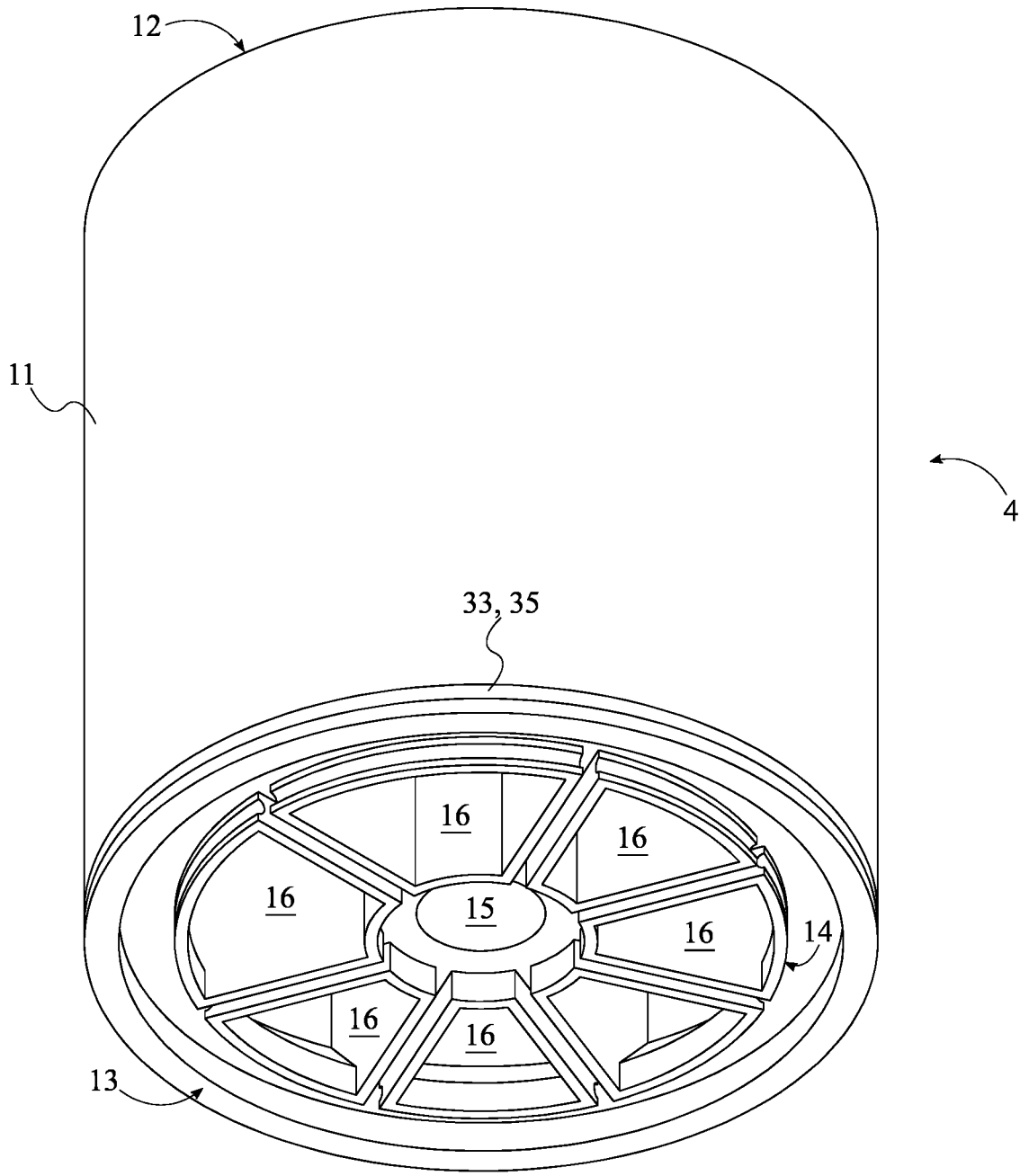
FIG. 17 is a bottom-rear perspective view showing the holder body of the present invention.
Figure 18:
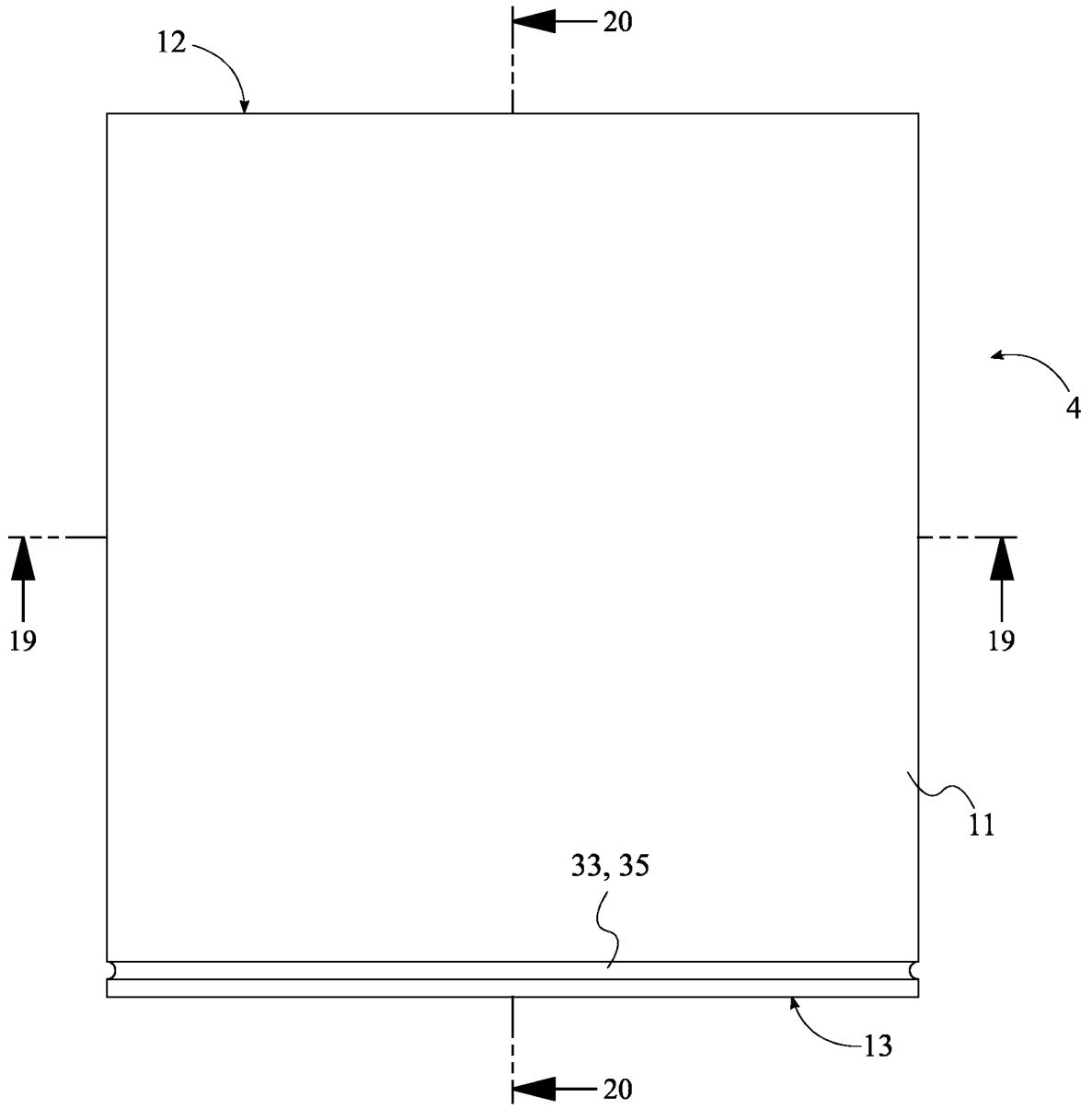
FIG. 18 is a front view showing the holder body of the present invention.
Figure 19:
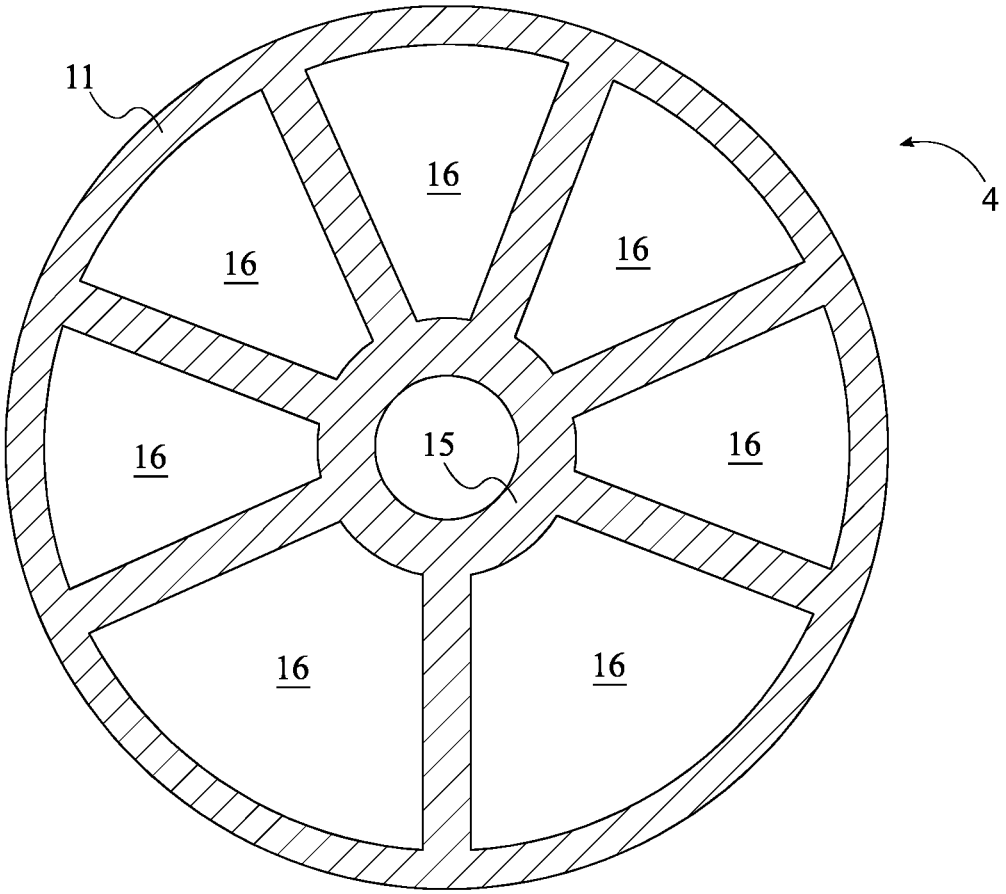
FIG. 19 is a horizontal cross-sectional view taken in the direction of line 19-19 in FIG. 18.
Figure 20:
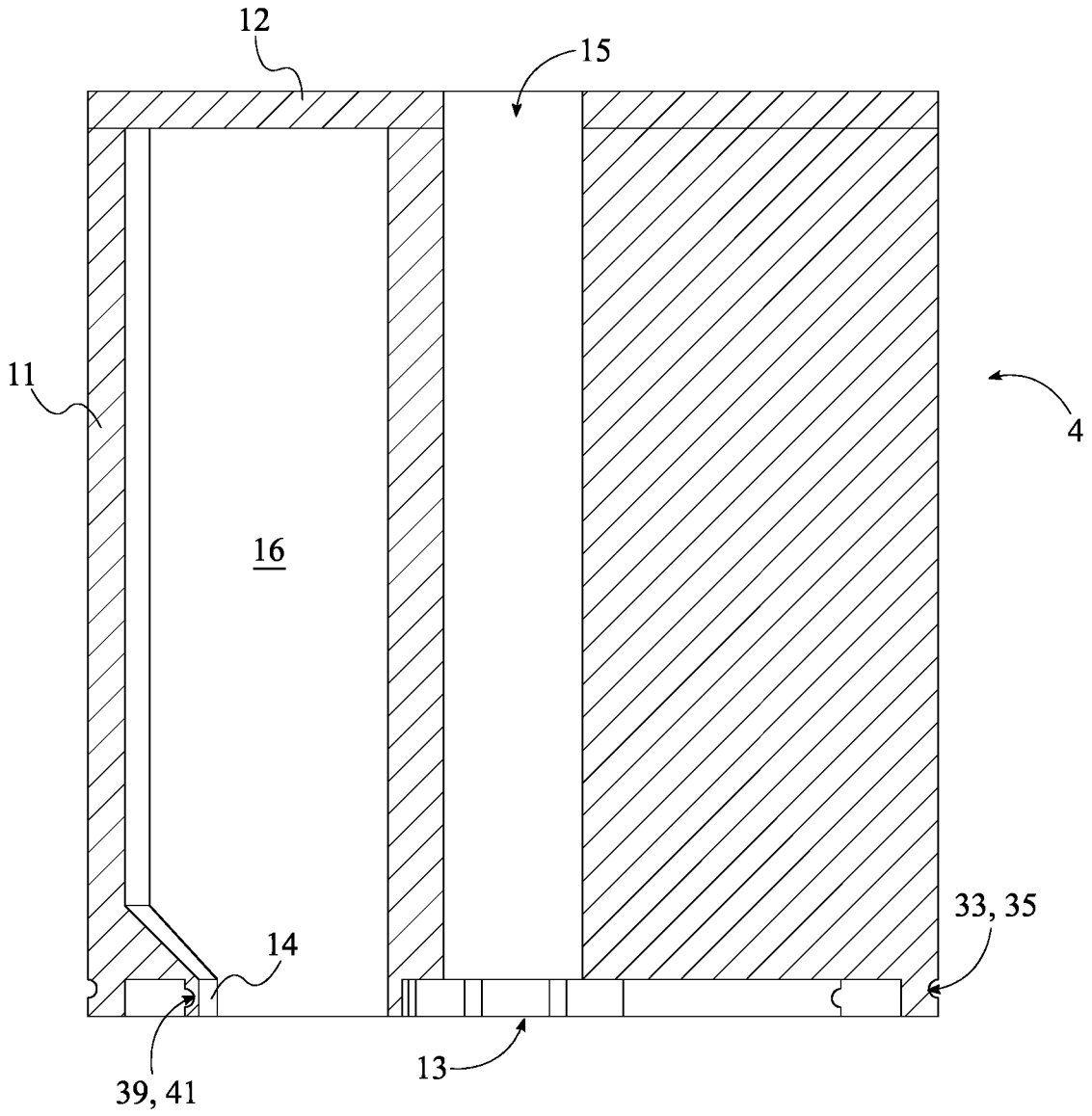
FIG. 20 is a vertical cross-sectional view taken in the direction of line 19-19 in FIG. 18.
Figure 21:
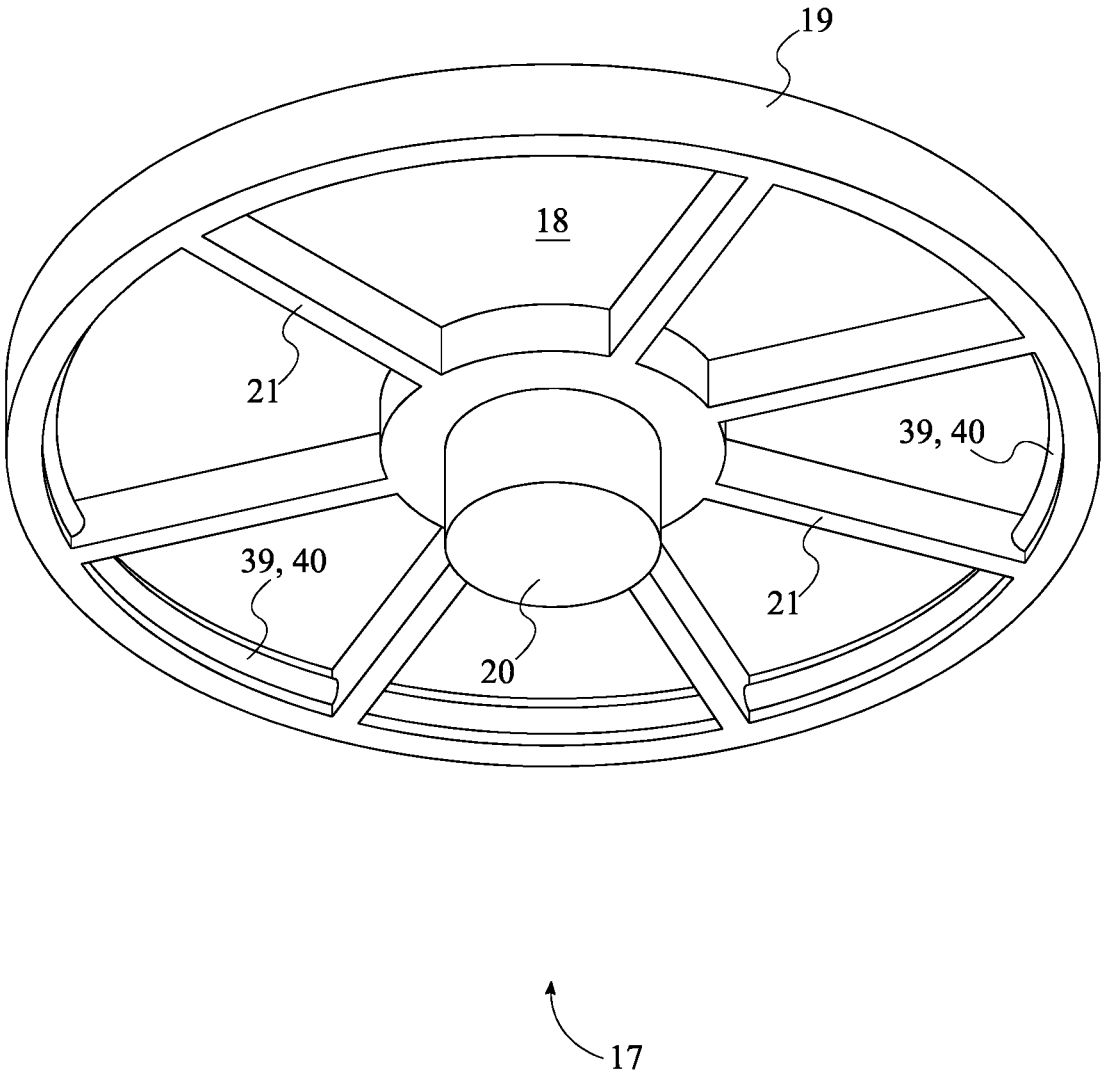
FIG. 21 is a top-front perspective view showing the holder lid of the present invention.

All illustrations of the drawings are for the purpose of describing selected versions of the present invention and are not intended to limit the scope of the present invention.

The present invention is a ready to mix and drink cocktail bottle that enables a user to selectively mix fresh ingredients with a liquid base to make a desired beverage on the go. As can be seen in FIG. 1 through 4, the present invention comprises a container body 1 and a mixing mechanism 4. The container body 1 serves to retain an amount of liquid base to make the desired beverage. In addition, the container body 1 retains the final mixed beverage after mixing and facilitates the consumption of the final mixed beverage. The mixing mechanism 4 serves to retain the several beverage ingredients separate from each other until mixing. The mixing mechanism 4 retains the several beverage ingredients in such a way that the freshness of the beverage ingredients is preserved. The mixing mechanism 4 also facilitates the mixing of the beverage ingredients with the amount of liquid base retained within the container body 1 when the user is ready to consume the mixed beverage.

The general configuration of the aforementioned components enables the user to make a desired beverage on the go without having to prepare the beverage ingredients or using several tools to mix all the beverage ingredients. As can be seen in FIG. 1 through 4, the mixing mechanism 4 is designed to facilitate the separate storage of all the beverage ingredients to preserve the freshness of the beverage ingredients until the user desires to mix the beverage ingredients. To do so, the mixing mechanism 4 comprises a mixing body 5, a holder body 11, a holder lid 17, an engaging cap 22, a pushing rod 27, and a bayonet connector 30. The mixing body 5 serves as the mixing area where the beverage ingredients are mixed with the base liquid stored in the container body 1. The holder body 11 is preferably a cylindrical hollow structure that serves to hold the several beverage ingredients separate from each other in order to preserve the freshness of the individual ingredient. The holder lid 17 serves to keep the beverage ingredients within the holder body 11 until the beverage ingredients are mixed with the base liquid. The engaging cap 22 serves to engage the pushing rod 27 to release holder lid 17 which enables the beverage ingredients to be mixed with the base liquid. The bayonet connector 30 enables the engagement of the engaging cap 22 while securing the engaging cap 22 to the mixing body 5. Furthermore, the holder body 11 comprises a holder base 12, a holder opening 13, a rod channel 15, and a plurality of storage chambers 16. The holder base 12 preferably corresponds to the closed base of the cylindrical holder body 11, while the holder opening 13 corresponds to the open base. The rod channel 15 is a through channel that accommodates the pushing rod 27 so that the pushing rod 27 can engage with the holder lid 17. The plurality of storage chambers 16 includes several individual storage chambers of various sizes designed to separately hold the beverage ingredients. The beverage ingredients can include, but are not limited to, liquid ingredients such as fruit juice and/or solid ingredients such as garnishes.

As can be seen in FIG. 1 through 4, to assemble the present invention, the mixing body 5, the holder body 11, the engaging cap 22, the pushing rod 27, the rod channel 15, and the holder lid 17 are axially aligned with the container body 1. Like the holder body 11, the mixing body 5, the engaging cap 22, and the container body 1 are also overall cylindrical hollow structures. The holder body 11 preferably has an outer diameter that matches the inner diameter of the mixing body 5. The engaging cap 22 has an inner diameter that matches the outer diameter of the mixing body 5. On the other hand, the container body 1 has an outer diameter that matches the outer diameter of the mixing body 5. In addition, the holder lid 17 has an overall circular shape with an overall size that matches the holder opening 13. This way, when put together, the mixing body 5, the holder body 11, and the container body 1 form an overall enlarged cylindrical structure.

Due to the overall cylindrical shape of the holder body 11, the holder base 12 is positioned opposite to the holder opening 13 across the holder body 11. The rod channel 15 traverses through the holder body 11 to enable the pushing rod 27 to pass through the holder body 11. Further, the plurality of storage chambers 16 is radially distributed about the rod channel 15. Each of the plurality of storage chambers 16 is also integrated within the holder body 11. This way, the several beverage ingredients are stored separately within the holder body 11 by storing each ingredient inside a corresponding storage chamber from the plurality of storage chambers 16. Further, the holder lid 17 is mounted onto the holder opening 13 to seal the holder body 11 and prevent the several beverage ingredients from mixing preemptively.

Furthermore, as can be seen in FIG. 1 through 4, to ensure that the several beverage ingredients in the holder body 11 mix with the base liquid retained inside the container body 1, the holder opening 13 is positioned within the mixing body 5. On the other hand, the holder base 12 is positioned external to the mixing body 5. This way, when the holder lid 17 is released by the pushing rod 27, the holder opening 13 is oriented towards the mixing body 5 where the several beverage ingredients can mix with the base liquid. In addition, to ensure that the pushing rod 27 can engage with the holder lid 17 to release the beverage ingredients, the engaging cap 22 is terminally connected to the pushing rod 27. This way, the pushing rod 27 is moved along with the engaging cap 22 when the engaging cap 22 is maneuvered by the user. The pushing rod 27 is also slidably mounted within the rod channel 15 so that the pushing rod 27 can slide through the holder body 11 to release the holder lid 17. To ensure that the user can maneuver the engaging cap 22, the engaging cap 22 is positioned adjacent to the holder base 12. The engaging cap 22 is also rotatably connected to the mixing body 5 by the bayonet connector 30. The bayonet connector 30 is designed to enable the controlled movement of the engaging cap 22 along the mixing body 5 while securing the engaging cap 22 to the mixing body 5. Finally, the container body 1 is positioned opposite to the engaging cap 22 across the mixing body 5. The container body 1 is also terminally connected to the mixing body 5. This way, the container body 1 is kept separate from the holder body 11 to leave enough space inside the mixing body 5 to enable the base liquid to mix with the several beverage ingredients.

As previously discussed, the holder opening 13 is positioned within the mixing body 5. However, the holder body 11 is fixed inside the mixing body 5 so that the holder body 11 is not loose within the mixing body 5. As can be seen in FIGS. 6, 14, 15, 16, and 17, the present invention may further comprise a first coupler 33 that secures the holder body 11 to the mixing body 5. The first coupler 33 comprises a first coupling protrusion 34 and a first coupling indentation 35 that enable the secure removable attachment of the holder body 11 to the mixing body 5. The first coupling protrusion 34 is preferably a round ring protrusion 38 that is concentric with the mixing body 5. The first coupling indentation 35 is preferably a hemispherical ring indentation around the holder opening 13. This way, the holder body 11 can be removed from the mixing body 5 to restock the beverage ingredients inside the holder body 11. In addition, the mixing body 5 is preferably an open-ended cylindrical structure to enable the flow of the base liquid from the container body 1 and the several beverage ingredients from the holder body 11 into the mixing body 5. To do so, the mixing body 5 comprises a first open end 6 and a second open end 7 corresponding to the open bases of the mixing body 5. Accordingly, the first open end 6 is positioned opposite to the second open end 7 across the mixing body 5 due to the overall cylindrical structure of the mixing body 5. This also results in a spacious mixing space within the mixing body 5.

As can be seen in FIGS. 6, 14, 15, 16, and 17, to enable the removable attachment of the holder body 11 to the mixing body 5, the first coupling protrusion 34 is positioned offset to the first open end 6. This enables the holder body 11 to be positioned within the mixing body 5 deep enough to be securely attached to the mixing body 5. The first coupling protrusion 34 is also integrated within the mixing body 5 to securely receive the first coupling indentation 35. On the other hand, the first coupling indentation 35 is positioned adjacent to the holder opening 13 so that the holder opening 13 is securely positioned within the mixing body 5. The first coupling indentation 35 is also integrated into the holder body 11 to secure the holder body 11 to the mixing body 5. To removably attach the holder body 11 to the mixing body 5, the holder opening 13 is inserted into the mixing body 5 and slid through the mixing body 5 until the first coupling indentation 35 is adjacent to the first coupling protrusion 34. Then the first coupling protrusion 34 is engaged with the first coupling indentation 35 which securely attaches the holder body 11 to the mixing body 5. In some embodiments, the mixing body 5 may also include a holder stopper that prevents the holder body 11 from sliding too deep into the mixing body 5 if the first coupler 33 fails. Similar to the first coupling protrusion 34, the holder stopper is a square ring protrusion 38 that is concentric with the mixing body 5. The holder stopper is positioned adjacent to the first coupling protrusion 34, opposite to the first open end 6. In addition, the holder stopper is integrated within the mixing body 5 to stop the holder opening 13 from sliding past the first coupling protrusion 34. This way, the holder body 11 is kept in position within the mixing body 5.

Figure 24:
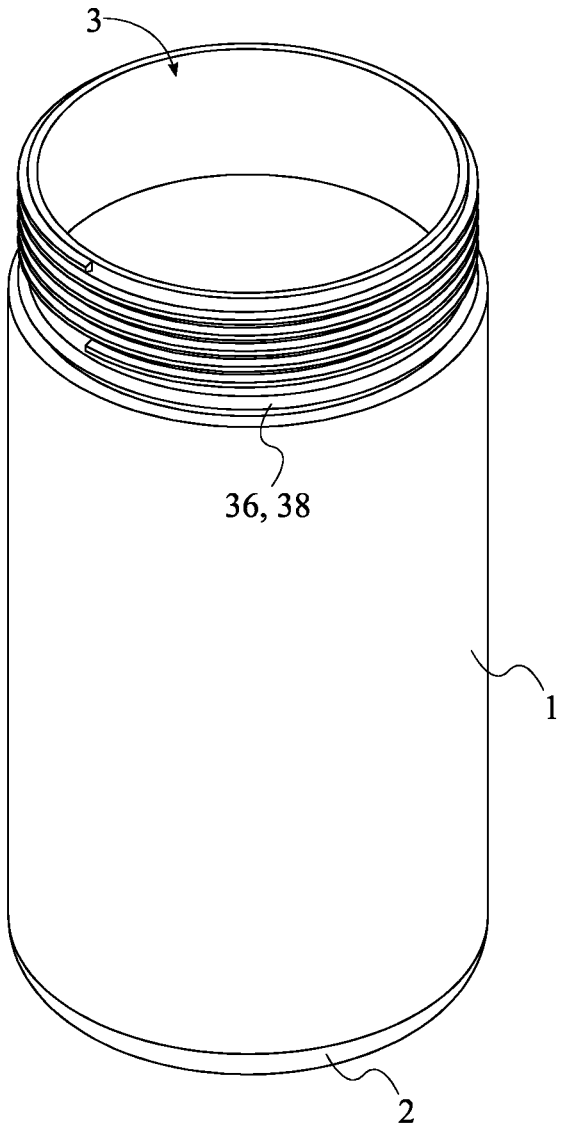
FIG. 24 is a top-front perspective view showing the container body of the present invention.
Figure 25:
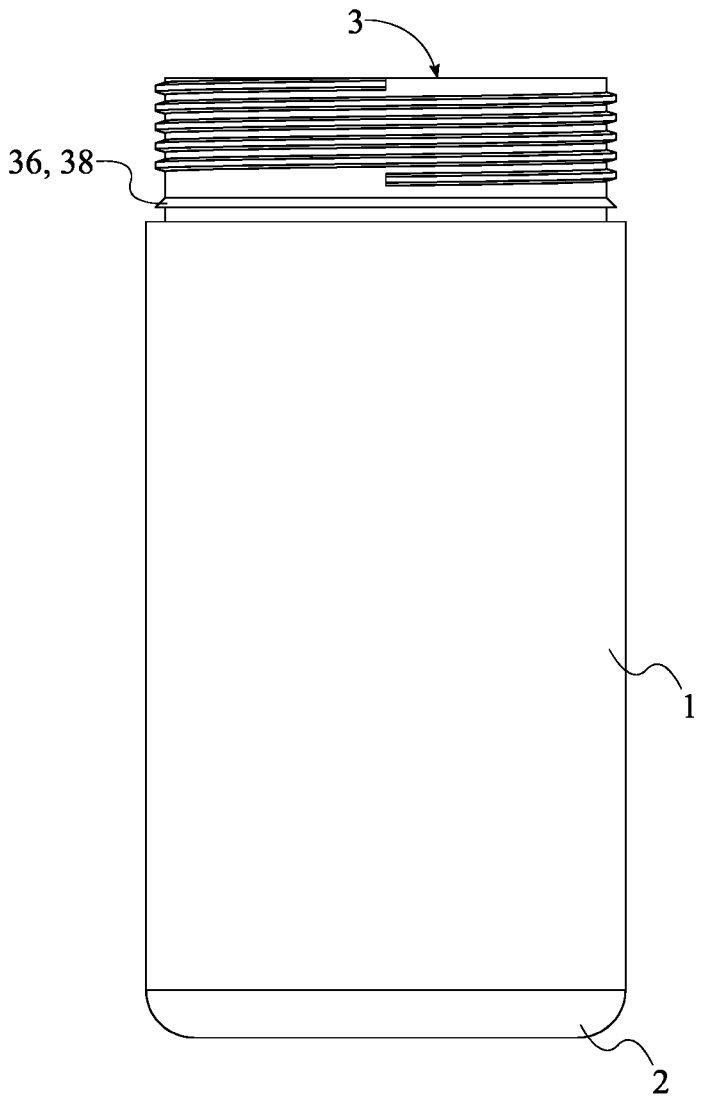
FIG. 25 is a front view showing the container body of the present invention.
Figure 26:
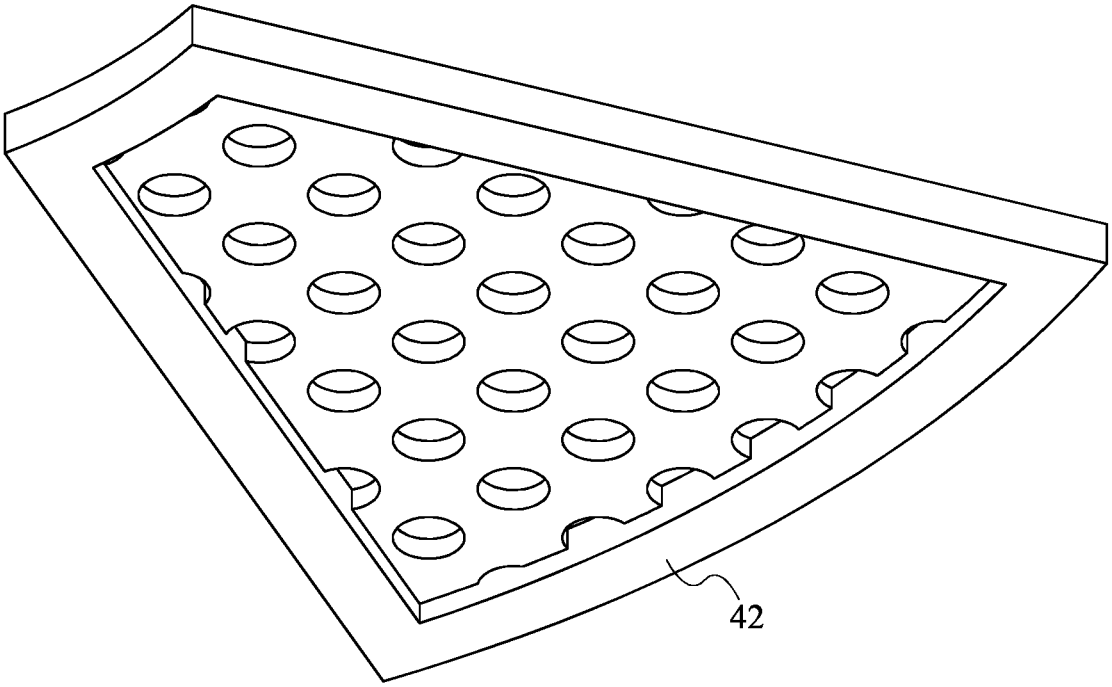
FIG. 26 is a top-front perspective view showing the at least one chamber strainer of the present invention.

As previously discussed, the container body 1 is designed to retain the base liquid that is to be mixed with the beverage ingredients to make a desired mixed beverage. The container body 1 is preferably a transparent hollow cylindrical structure with a size large enough to hold desired amounts of base liquid. The base liquid can include, but is not limited to, water, juice, an alcoholic beverage, etc. The container body 1 can also be provided in different sizes corresponding to the different amounts of base liquid. For example, the container body 1 can be provided in a small size, a medium size, a large size, etc. In addition, the container body 1 retains the mixed beverage for consumption. As can be seen in FIGS. 24 and 25, to do so, the container body 1 comprises a container base 2 and a container opening 3. The container base 2 and the container opening 3 correspond to the closed base and the open base of the container body 1, respectively. Due to the overall cylindrical shape of the container body 1, the container base 2 is positioned opposite to the container opening 3 across the container body 1. Further, the container opening 3 is connected to the second open end 7 to secure the container body 1 to the mixing body 5. The container opening 3 can be connected to the second open end 7 in different ways. For example, male thread can be provided on the exterior of the container opening 3, while female thread can be provided on the interior of the second open end 7. This way, the container opening 3 can be screwed into the second open end 7. However, other connections can be used that enable the removable connection between the container opening 3 and the second open end 7.

In some embodiments, the present invention may further comprise a tamper-evident mechanism 36. As can be seen in FIGS. 12 through 15, 24, and 25, the tamper-evident mechanism 36 serves to assure the user that the beverage ingredients and the base liquid stored within the present invention have not been tampered with. The tamper-evident mechanism 36 is especially useful to prevent other users from adding undesired ingredients to the mixed beverage before the user consumes the mixed beverage. To do so, the tamper-evident mechanism 36 comprising a security band 37 and a ring protrusion 38. The security band 37 serves to visually show that the present invention has not been tampered. The ring protrusion 38 serves to break the security band 37 once the container body 1 has been removed from the mixing body 5. Accordingly, the security band 37 is coincident with the second open end 7. The security band 37 is also terminally connected to the second open end 7 to secure the security band 37 to the second open end 7. On the other hand, the ring protrusion 38 is coincident with the container opening 3. The ring protrusion 38 is also integrated into the container opening 3. This way, when the container opening 3 is connected to the second open end 7 during the manufacturing process, the ring protrusion 38 is engaged with the security band 37. If the container body 1 is removed from the mixing body 5, the ring protrusion 38 pulls on the security band 37 until the security band 37 is removed from the mixing body 5. Thus, the user can check for the condition of the beverage ingredients and the base liquid by ensuring that the security band 37 is still connected to the mixing body 5. If the security band 37 is detached from the mixing body 5, the user can determine that the container body 1 has been removed from the mixing body 5 and that the various ingredients could have been tampered with.

After the holder lid 17 has been released from the holder opening 13 by the pushing rod 27, the holder lid 17 must be kept out of the container body 1 so that the holder lid 17 does not obstruct with the consumption of the mixed beverage. As can be seen in FIGS. 10, 11, 14, and 15, to do so, the mixing body 5 may further comprise a lid stopper 8. The lid stopper 8 is an integral feature within the mixing body 5 that keeps the released holder lid 17 within the mixing body 5 but also enables the free flow of the base liquid and the beverage ingredients through the mixing body 5. Accordingly, the lid stopper 8 comprises a stopper body 9 and a plurality of stopper holes 10. The stopper body 9 is a disc-shaped structure designed to match the inner structure of the mixing body 5 to cover the interior of the mixing body 5. The plurality of stopper holes 10 enables the flow of the base liquid and the beverage ingredients through the stopper body 9. To integrate the lid stopper 8 within the mixing body 5, the plurality of stopper holes 10 is radially distributed about the stopper body 9. The distribution of the plurality of stopper holes 10 on the stopper body 9 ensures that there is the least obstruction to the flow of the base liquid and the beverage ingredients through the stopper body 9. The plurality of stopper holes 10 also traverses through the disc body so that the base liquid and the beverage ingredients can flow through the stopper body 9. Further, the stopper body 9 is axially aligned with the mixing body 5 so that the stopper body 9 is symmetrically integrated within the mixing body 5. The stopper body 9 is positioned offset to the second open end 7 to leave a space between the stopper body 9 and the first coupler 33 for the holder lid 17 to freely move without blocking the flow of the beverage ingredients or the base liquid. This enables the holder lid 17 to also function as a whisk to aid with the mixing of the base liquid with the beverage ingredients. In addition, the stopper body 9 is mounted within the mixing body 5 to securely connect the lid stopper 8 to the mixing body 5. In other embodiments, the holder lid 17 may be prevented from entering the container body 1 by other means, such as hingedly connecting the holder lid 17 to the holder opening 13.

Figure 22:
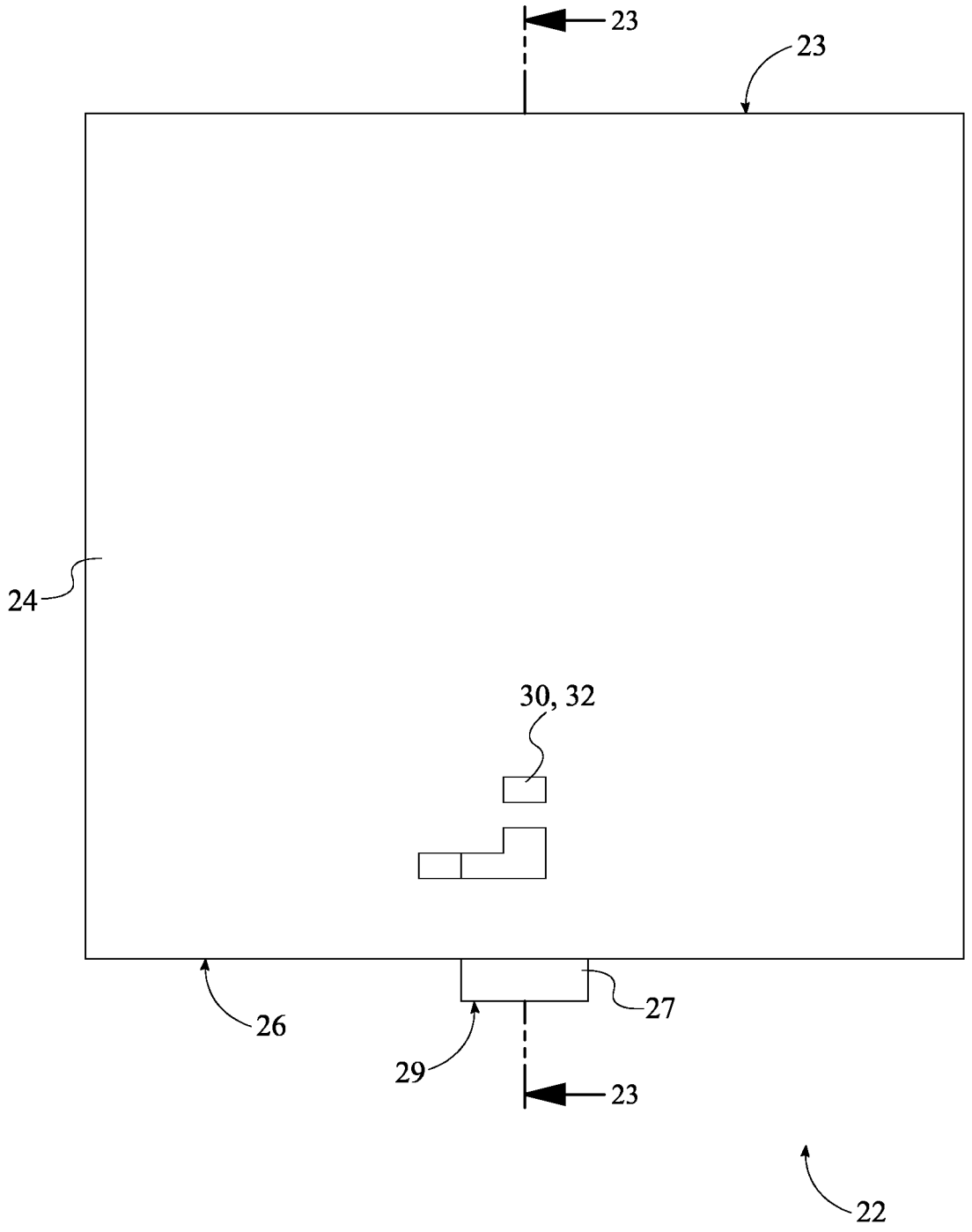
FIG. 22 is a front view showing the engaging cap of the present invention.
Figure 23:
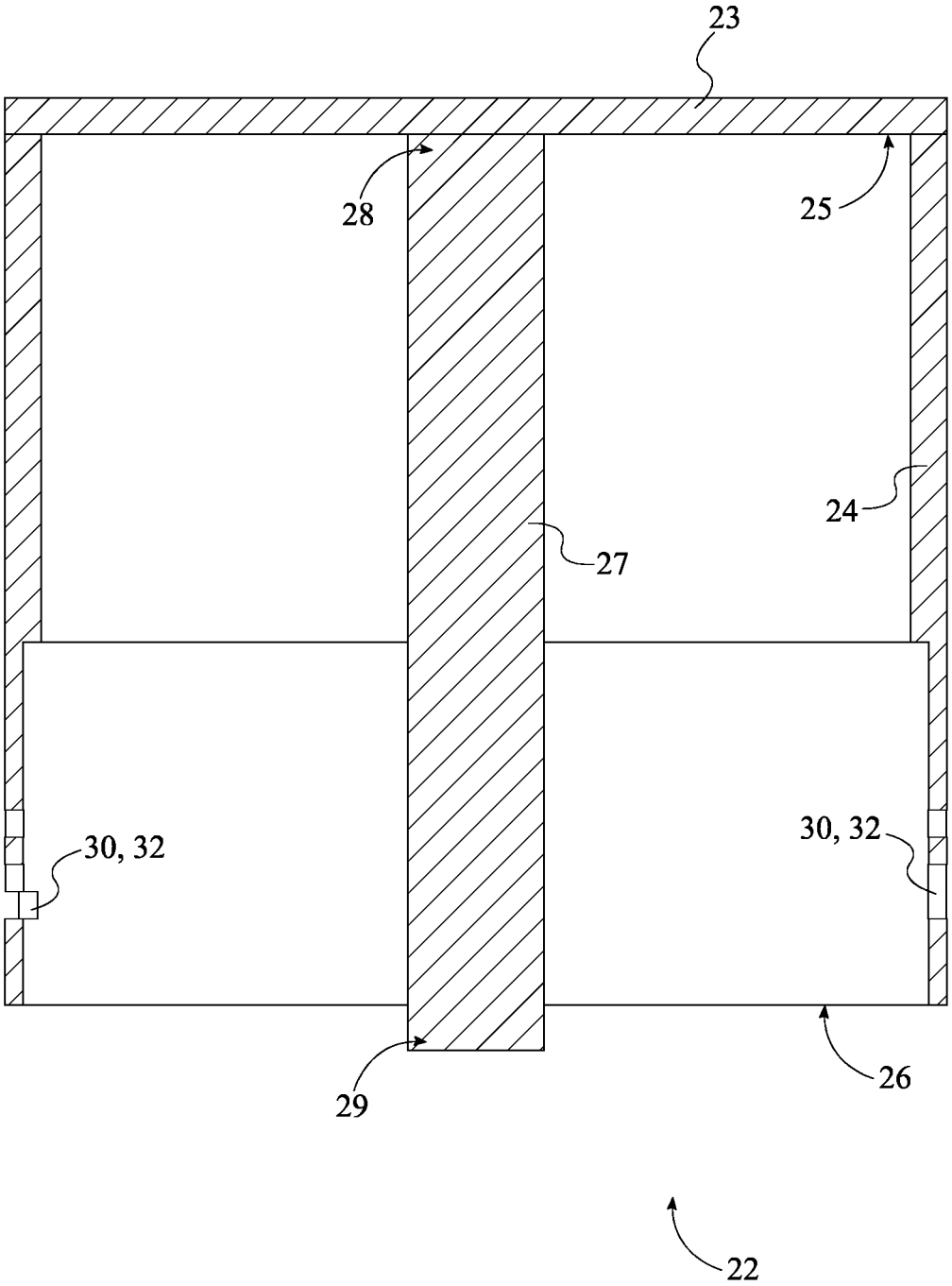
FIG. 23 is a vertical cross-sectional view taken in the direction of line 23-23 in FIG. 22.

As previously discussed, the engaging cap 22 not only serves to seal the connection of the holder body 11 to the mixing body 5, but also serves as the trigger to release the holder lid 17 from the holder opening 13 using the pushing rod 27. As can be seen in FIGS. 22 and 23, to do so, the engaging cap 22 may comprise a cap base 23 and a cap lateral wall 24. The cap base 23 and the cap lateral wall 24 are designed to enclose the holder base 12 and function as a manual trigger that the user can maneuver to release the holder lid 17, which then enables the user to mix the base liquid with the beverage ingredients. Accordingly, the cap lateral wall 24 is axially aligned with the cap base 23 to form the overall cylindrical structure of the engaging cap 22. The cap base 23 is terminally connected to the cap lateral wall 24 to form a single cylindrical cap structure that encloses the holder base 12. Further, the pushing rod 27 is centered on the cap base 23 to match the position of the rod channel 15 in the holder body 11. The cap base 23 is also terminally connected to the pushing rod 27 to secure the pushing rod 27 to the engaging cap 22. This way, the pushing rod 27 follows the movement of the engaging cap 22 as the user maneuvers the engaging cap 22. Furthermore, the holder base 12 is positioned within the cap lateral wall 24 so that the holder base 12 is enclosed by the engaging cap 22. The cap base 23 is also positioned offset to the holder base 12 to leave space for the engaging cap 22 to be moved by the user when the user maneuvers the engaging cap 22 to release the holder lid 17.

While the engaging cap 22 can be maneuvered by the user, the engaging cap 22 is secured to the mixing body 5 to prevent the engaging cap 22 from coming loose. As can be seen in FIG. 3 through 11, bayonet connector 30 ensures that the engaging cap 22 is secured to the mixing body 5 while enabling the engaging cap 22 to be maneuvered. To do so, the bayonet connector 30 comprises a pair of pins 31 and a pair of slots 32. The pair of pins 31 along with the pair of slots 32 enable the movement of the engaging cap 22 about the mixing body 5 while preventing the engaging cap 22 from coming off. The pair of pins 31 preferably includes small pins that protrude outside the mixing body 5 to engage with the pair of slots 32. The pair of slots 32 preferably includes L-shaped slots on the cap lateral wall 24 that enable the engaging cap 22 to be moved rotationally and linearly. The pair of slots 32 is preferably oriented so that the movement of the engaging cap 22 also moves the pushing rod 27 towards the holder lid 17 to release the holder lid 17 from the holder opening 13. Accordingly, the pair of pins 31 is radially distributed about the mixing body 5 so that engaging cap 22 is securely connected to the mixing body 5. The pair of pins 31 is also positioned adjacent to the holder body 11 so that the cap lateral wall 24 does not need to extend too much into the mixing body 5. Further, the pair of pins 31 is integrated into the mixing body 5 to securely support the movement of the engaging cap 22 about the mixing body 5. Similar to the pair of pins 31, the pair of slots 32 is radially distributed about the cap lateral wall 24 to match the positioning of the pair of pins 31. The pair of slots 32 is also positioned adjacent to the mixing body 5 so that the pair of pins 31 is positioned adjacent to the pair of slots 32. Further, the pair of slots 32 is integrated into the cap lateral wall 24. Finally, to secure the engaging cap 22 to the mixing body 5, each pin of the pair of pins 31 is slidably engaged with a corresponding slot of the pair of slots 32. This way, when the pair of pins 31 is resting on the horizontal section of the L-shaped pair of slots 32, the engaging cap 22 can only be rotated about the mixing body 5 without releasing the holder lid 17. If the user desires to remove the holder lid 17 from the holder opening 13, the engaging cap 22 is rotated by the user so that the pair of pins 31 is moved towards the vertical section of the L-shaped pair of slots 32. Then, the user moves the engaging cap 22 towards the mixing body 5. The pair of pins 31 guides the linear movement as the pair of pins 31 slide along the vertical section of the L-shaped pair of slots 32. This way, the pushing rod 27 is also moved towards the mixing body 5 inside the rod channel 15 until the pushing rod 27 engages with the holder lid 17 to release the holder lid 17 from the holder opening 13. In other embodiments, other mechanisms can be utilized by the present invention to enable the user to maneuver the engaging cap 22 to release the holder lid 17.

As previously discussed, the pushing rod 27 is an elongated rod structure that serves to release the holder lid 17 from the holder opening 13. The pushing rod 27 preferably transfers the linear force applied by the user on the engaging cap 22 to the holder lid 17 to force the holder lid 17 to come off the holder opening 13. As can be seen in FIGS. 10, 11, 22, and 23, the pushing rod 27 may comprise a first rod end 28 and a second rod end 29 corresponding to the terminal ends of the pushing rod 27. In addition, the cap lateral wall 24 may comprise a first wall edge 25 and a second wall edge 26 due to the overall cylindrical structure of the cap lateral wall 24. Due to the elongated shape of the pushing rod 27, the first rod end 28 is positioned opposite to the second rod end 29 along the pushing rod 27. Similarly, the first wall edge 25 is positioned opposite to the second wall edge 26 across the cap lateral wall 24. Further, the first rod end 28 is connected to the cap base 23 which terminally connects the cap base 23 to the pushing rod 27. Likewise, the first wall edge 25 is peripherally connected to the cap base 23 to secure the cap lateral wall 24 to the cap base 23. In addition, the second rod end 29 is positioned offset to the second wall edge 26 to offset the second rod end 29 from the second wall edge 26. In other words, the second rod end 29 extends past the cap lateral wall 24 to position the second rod end 29 outside the cap lateral wall 24. Since the pushing rod 27 is hidden within the holder body 11, this eliminates the need to match the length of the cap lateral wall 24 with the length of the pushing rod 27. This also enables the pushing rod 27 to be long enough to engage with the holder lid 17.

As previously discussed, the holder lid 17 remains attached to the holder opening 13 prior the mixing of the beverage ingredients with the base liquid in order to keep the beverage ingredients fresh. As can be seen in FIGS. 5 through 11 and 17 through 21, to prevent any accidental release of the holder lid 17, the present invention may further comprise a second coupler 39. Like the first coupler 33, the second coupler 39 is designed to enable the removable attachment of the holder lid 17 to the holder opening 13. In addition, the holder lid 17 may comprise a lid base 18 and a lid lip 19. The lid base 18 is designed to cover the holder opening 13, while the lid lip 19 is designed to engage the holder opening 13. Further, the holder opening 13 may comprise an opening lip 14 that helps the holder lid 17 to be secured to the holder opening 13. The second coupler 39 also comprises a second coupling protrusion 40 and a first coupling indentation 35. The second coupling protrusion 40 is integrated within the lid lip 19 to securely receive the second coupling indentation 41. On the other hand, the second coupling indentation 41 is positioned on the opening lip 14 to receive the second coupling protrusion 40. To integrate the second coupler 39, the lid lip 19 is peripherally connected to the lid base 18 to form a single lid structure. The opening lip 14 is centrally positioned within the holder opening 13 to match the circular holder opening 13. The opening lip 14 is also integrated into the holder opening 13 to secure the opening lip 14 to the holder opening 13. Further, the second coupling protrusion 40 is integrated into the lid lip 19 so that the second coupling protrusion 40 is positioned within the lid lip 19. On the other hand, the second coupling indentation 41 is integrated into the opening lip 14 so that the second coupling indentation 41 is positioned outside the opening lip 14. Then, to removably attach the holder lid 17 to the holder opening 13, the second coupling protrusion 40 is engaged with the second coupling indentation 41. This way, when the pushing rod 27 is pressed against the holder lid 17, the holder lid 17 can be released from the holder opening 13 without requiring too much force.

As can be seen in FIGS. 5 through 11 and 21, to ensure that the pushing rod 27 presses against the holder lid 17 to release the holder lid 17 from the holder opening 13, the holder lid 17 may further comprise a rod bumper 20 that receives the pushing rod 27 when the pushing rod 27 presses against the holder lid 17. The rod bumper 20 is preferably a short cylindrical protrusion that can be made of elastic or semi elastic materials to prevent damage to the holder lid 17. The rod bumper 20 has a size large enough to fit within the rod channel 15 to engage with the pushing rod 27. The rod bumper 20 is positioned adjacent to the lid lip 19 so that the rod bumper 20 can be inserted into the rod channel 15. The rod bumper 20 is also centrally positioned on the lid base 18 to match the position of the rod channel 15 in the holder body 11. Further, the rod bumper 20 is mounted onto the lid base 18 to secure the rod bumper 20 to the lid base 18. Finally, when the holder lid 17 is removably attached to the holder opening 13, the rod bumper 20 is positioned within the rod channel 15. This way, when the user maneuvers the engaging cap 22 to move the pushing rod 27 against the holder lid 17, the second rod end 29 is pressed against the rod bumper 20, which then forces the second coupler 39 to release due to the lid base 18 being pushed away from the holder opening 13 by the pushing rod 27.

As can be seen in FIGS. 5 through 11 and 21, to further preserve the freshness of the beverage ingredients, the holder lid 17 can be designed to individually seal each storage chamber to maintain the corresponding beverage ingredients sealed until the beverage ingredients are mixed with the base liquid. To do so, the holder lid 17 may further comprise a plurality of chamber plugs 21 that seal the plurality of storage chambers 16 when the holder lid 17 is removably attached to the holder opening 13. Accordingly, the plurality of chamber plugs 21 is positioned adjacent to the lid lip 19 so that the plurality of chamber plugs 21 can engage with the plurality of storage chambers 16. The plurality of chamber plugs 21 is also radially distributed about the lid base 18 to match the distribution of the plurality of storage chambers 16 in the holder body 11. Further, the plurality of chamber plugs 21 is mounted onto the lid base 18 to secure the plurality of chamber plugs 21 to the holder lid 17. Finally, when the holder lid 17 is removably attached to the holder opening 13, each of the plurality of chamber plugs 21 is hermetically connected to a corresponding storage chamber of the plurality of storage chambers 16. This way, all beverage ingredients stored within the plurality of storage chambers 16 are kept fresh and separated until the beverage ingredients are mixed with the base liquid.

As previously discussed, the present invention enables the storage of fresh beverage ingredients so that the user can enjoy the best mixed beverage. Some beverage ingredients may include elements that the user may not want on the final mixed beverage such as, but not limited to, seeds, pulp, leaves, etc. As can be seen in FIGS. 5 through 11 and 26, to prevent these unwanted elements from getting into the final mixed beverage, the present invention may further comprise at least one chamber strainer 42. The at least one chamber strainer 42 is designed to fit into a corresponding storage chamber from the plurality of storage chambers 16 to filter out unwanted elements from the beverage ingredient. To do so, the at least one chamber strainer 42 is positioned adjacent to the holder opening 13 to leave the most storage space within the corresponding storage chamber to hold the desired amount of beverage ingredient. Further, the at least one chamber strainer 42 is mounted into a storage chamber of the plurality of storage chambers 16 to secure the at least one chamber strainer 42 to the corresponding storage chamber. This way, when the holder lid 17 is released from the holder opening 13, the stored beverage ingredient is strained by the at least one chamber strainer 42 so that only the desired elements from the beverage ingredient are mixed with the base liquid and the other beverage ingredients. In some embodiments, several chamber strainers can be provided to cover multiple storage chambers that retain beverage ingredients that need to be strained.

In an exemplary embodiment, after filling the beverage ingredients in plurality of storage chambers 16, the holder lid 17 is removably attached onto the holder opening 13 which would make a clicking sound indicating proper placement due to the second coupler 39. After, the holder body 11 is removably attached into the mixing body 5 using the first coupler 33. The first coupler 33 would also make a clicking sound indicating proper placement. Then, the engaging cap 22 would be mounted onto the holder base 12 until the engaging cap 22 is connected to the mixing body 5 using the bayonet connector 30. This way, the engaging cap 22 encloses the holder base 12. In addition, the container base 2 is filled with an amount of base liquid. The container body 1 would be semi-filled to be able to accommodate the beverage ingredients that are stored in the holder body 11 after mixing. Once the container body 1 is filled, the container body 1 is connected to the mixing body 5.

In some embodiments, the engaging cap 22 can include visual indicators that show the way the user must maneuver the engaging cap 22 to release the holder lid 17. For example, a horizontal arrow with a corresponding number label (e.g., #1) can be inscribed onto the engaging cap 22 adjacent to the horizontal sections of the L-shaped pair of slots 32 to show the user that the user must first rotate the engaging cap 22 towards the shown direction. In addition, a vertical arrow with a corresponding number label (e.g., #2) can be inscribed onto the engaging cap 22 adjacent to the vertical sections of the L-shaped pair of slots 32 to show the user that the user must then push the engaging cap 22 towards the shown direction to release the holder lid 17. This way, as can be seen in FIG. 5 through 11, when the user first rotates the engaging cap 22, the pair of pins 31 is positioned so that the pair of pins 31 can slide along the vertical sections of the corresponding L-shaped pair of slots 32. Then, after pushing the engaging cap 22 towards the mixing body 5, the pushing rod 27 engages with the holder lid 17 to release the holder lid 17, which releases the beverage ingredients within the holder body 11 to be mixed with the base liquid.

As can be seen in FIG. 10 through 13, the space between the first coupler 33 and the lid stopper 8 serves as the mixing space that simulates the function of a Boston Shaker. Once the holder lid 17 is removed, the beverage ingredients flow from the holder body 11 to the container body 1 due to the shaking of the present invention by the user. The container body 1 is tightly connected to the mixing body 5 so nothing can get out. In addition, the lid stopper 8 prevents the holder lid 17 from moving into the container body 1 so that the holder lid 17 along with the lid stopper 8 facilitate the mixing of the beverage ingredients with the base liquid during the shaking process. The space between the first coupler 33 and the lid stopper 8 is large enough to enable the free movement of the holder lid 17 during mixing. After the user has thoroughly shaken the present invention to mix the beverage ingredients and the base liquid, the user orients the container body 1 so that the mixed beverage is positioned only in the container body 1. Then, the user can remove the container body 1 from the mixing body 5. The tamper-evident mechanism 36 would then be broken to show that the beverage ingredients nor the base liquid have been tempered with. The mixing body 5 along with the rest of the components can be discarded or placed aside for future use. Furthermore, the user can consume the mixed beverage directly from the container body 1 or pour the mixed beverage on another container for consumption.

Although the invention has been explained in relation to its preferred embodiment, it is to be understood that many other possible modifications and variations can be made without departing from the spirit and scope of the invention.

What is claimed is:

1. A ready to mix and drink cocktail bottle comprising:
- a container body;
- a mixing mechanism;
- the mixing mechanism comprising a mixing body, a holder body, a holder lid, an engaging cap, a pushing rod, and a bayonet connector;
- the holder body comprising a holder base, a holder opening, a rod channel, and a plurality of storage chambers;
- the mixing body, the holder body, the engaging cap, the pushing rod, the rod channel, and the holder lid being axially aligned with the container body;
- the holder base being positioned opposite to the holder opening across the holder body;
- the rod channel traversing through the holder body;
- the plurality of storage chambers being radially distributed about the rod channel;
- each of the plurality of storage chambers being integrated within the holder body;
- the holder lid being mounted onto the holder opening;
- the holder opening being positioned within the mixing body;
- the holder base being positioned external to the mixing body;
- the engaging cap being terminally connected to the pushing rod;
- the pushing rod being slidably mounted within the rod channel;
- the engaging cap being positioned adjacent to the holder base;
- the engaging cap being rotatably connected to the mixing body by the bayonet connector;
- the container body being positioned opposite to the engaging cap across the mixing body; and
- the container body being terminally connected to the mixing body.

2. The ready to mix and drink cocktail bottle as claimed in claim 1 comprising:
- a first coupler;
- the mixing body comprising a first open end and a second open end;
- the first coupler comprising a first coupling protrusion and a first coupling indentation;
- the first open end being positioned opposite to the second open end across the mixing body;
- the first coupling protrusion being positioned offset to the first open end;
- the first coupling protrusion being integrated within the mixing body;
- the first coupling indentation being positioned adjacent to the holder opening;
- the first coupling indentation being integrated into the holder body; and
- the first coupling protrusion being engaged with the first coupling indentation.

3. The ready to mix and drink cocktail bottle as claimed in claim 2 comprising:
- the container body comprising a container base and a container opening;
- the container base being positioned opposite to the container opening across the container body; and
- the container opening being connected to the second open end.

4. The ready to mix and drink cocktail bottle as claimed in claim 3 comprising:
- a tamper-evident mechanism;
- the tamper-evident mechanism comprising a security band and a ring protrusion;
- the security band being coincident with the second open end;
- the security band being terminally connected to the second open end;
- the ring protrusion being coincident with the container opening;
- the ring protrusion being integrated into the container opening; and
- the ring protrusion being engaged with the security band.

5. The ready to mix and drink cocktail bottle as claimed in claim 2 comprising:
- the mixing body further comprising a lid stopper;
- the lid stopper comprising a stopper body and a plurality of stopper holes;
- the plurality of stopper holes being radially distributed about the stopper body;
- the plurality of stopper holes traversing through the stopper body;

the stopper body being axially aligned with the mixing body;

the stopper body being positioned offset to the second open end; and the stopper body being mounted within the mixing body.

6. The ready to mix and drink cocktail bottle as claimed in claim 1 comprising:

the engaging cap comprising a cap base and a cap lateral wall;

the cap lateral wall being axially aligned with the cap base;

the cap base being terminally connected to the cap lateral wall;

the pushing rod being centered on the cap base;

the cap base being terminally connected to the pushing rod;

the holder base being positioned within the cap lateral wall; and the cap base being positioned offset to the holder base.

7. The ready to mix and drink cocktail bottle as claimed in claim 6 comprising:

the bayonet connector comprising a pair of pins and a pair of slots;

the pair of pins being radially distributed about the mixing body;

the pair of pins being positioned adjacent to the holder body;

the pair of pins being integrated into the mixing body;

the pair of slots being radially distributed about the cap lateral wall;

the pair of slots being positioned adjacent to the mixing body;

the pair of slots being integrated into the cap lateral wall; and each pin of the pair of pins being slidably engaged with a corresponding slot of the pair of slots.

8. The ready to mix and drink cocktail bottle as claimed in claim 6 comprising:

the pushing rod comprising a first rod end and a second rod end;

the cap lateral wall comprising a first wall edge and a second wall edge;

the first rod end being positioned opposite to the second rod end along the pushing rod;

the first wall edge being positioned opposite to the second wall edge across the cap lateral wall;

the first rod end being connected to the cap base;

the first wall edge being peripherally connected to the cap base; and the second rod end being positioned offset to the second wall edge.

9. The ready to mix and drink cocktail bottle as claimed in claim 1 comprising:

a second coupler;

the second coupler comprising a second coupling protrusion and a second coupling indentation;

the holder lid comprising a lid base and a lid lip;

the holder opening comprising an opening lip;

the lid lip being peripherally connected to the lid base;

the opening lip being centrally positioned within the holder opening;

the opening lip being integrated into the holder opening;

the second coupling protrusion being integrated into the lid lip;

the second coupling indentation being integrated into the opening lip; and the second coupling protrusion being engaged with the second coupling indentation.

10. The ready to mix and drink cocktail bottle as claimed in claim 9 comprising:

the holder lid further comprising a rod bumper;

the rod bumper being positioned adjacent to the lid lip;

the rod bumper being centrally positioned on the lid base;

the rod bumper being mounted onto the lid base; and the rod bumper being positioned within the rod channel.

11. The ready to mix and drink cocktail bottle as claimed in claim 9 comprising:

the holder lid further comprising a plurality of chamber plugs;

the plurality of chamber plugs being positioned adjacent to the lid lip;

the plurality of chamber plugs being radially distributed about the lid base;

the plurality of chamber plugs being mounted onto the lid base; and each of the plurality of chamber plugs being hermetically connected to a corresponding storage chamber of the plurality of storage chambers.

12. The ready to mix and drink cocktail bottle as claimed in claim 1 comprising:

at least one chamber strainer;

the at least one chamber strainer being positioned adjacent to the holder opening; and the at least one chamber strainer being mounted into a storage chamber of the plurality of storage chambers.

13. A ready to mix and drink cocktail bottle comprising:

a container body;

a mixing mechanism;

a first coupler;

the mixing mechanism comprising a mixing body, a holder body, a holder lid, an engaging cap, a pushing rod, and a bayonet connector;

the holder body comprising a holder base, a holder opening, a rod channel, and a plurality of storage chambers;

the mixing body comprising a first open end and a second open end;

the first coupler comprising a first coupling protrusion and a first coupling indentation;

the mixing body, the holder body, the engaging cap, the pushing rod, the rod channel, and the holder lid being axially aligned with the container body;

the holder base being positioned opposite to the holder opening across the holder body;

the rod channel traversing through the holder body;

the plurality of storage chambers being radially distributed about the rod channel;

each of the plurality of storage chambers being integrated within the holder body;

the holder lid being mounted onto the holder opening;

the holder opening being positioned within the mixing body;

the holder base being positioned external to the mixing body;

the engaging cap being terminally connected to the pushing rod;

the pushing rod being slidably mounted within the rod channel;

the engaging cap being positioned adjacent to the holder base;

the engaging cap being rotatably connected to the mixing body by the bayonet connector;

the container body being positioned opposite to the engaging cap across the mixing body;

the container body being terminally connected to the mixing body;

the first open end being positioned opposite to the second open end across the mixing body;

the first coupling protrusion being positioned offset to the first open end;

the first coupling protrusion being integrated within the mixing body;

the first coupling indentation being positioned adjacent to the holder opening;

the first coupling indentation being integrated into the holder body; and the first coupling protrusion being engaged with the first coupling indentation.

14. The ready to mix and drink cocktail bottle as claimed in claim 13 comprising:

a tamper-evident mechanism;

the tamper-evident mechanism comprising a security band and a ring protrusion;

the container body comprising a container base and a container opening;

the container base being positioned opposite to the container opening across the container body;

the container opening being connected to the second open end;

the security band being coincident with the second open end;

the security band being terminally connected to the second open end;

the ring protrusion being coincident with the container opening;

the ring protrusion being integrated into the container opening; and the ring protrusion being engaged with the security band.

15. The ready to mix and drink cocktail bottle as claimed in claim 13 comprising:

the mixing body further comprising a lid stopper;

the lid stopper comprising a stopper body and a plurality of stopper holes;

the plurality of stopper holes being radially distributed about the stopper body;

the plurality of stopper holes traversing through the stopper body;

the stopper body being axially aligned with the mixing body;

the stopper body being positioned offset to the second open end; and the stopper body being mounted within the mixing body.

16. The ready to mix and drink cocktail bottle as claimed in claim 13 comprising:

the bayonet connector comprising a pair of pins and a pair of slots;

the engaging cap comprising a cap base and a cap lateral wall;

the cap lateral wall being axially aligned with the cap base;

the cap base being terminally connected to the cap lateral wall;

the pushing rod being centered on the cap base;

the cap base being terminally connected to the pushing rod;

the holder base being positioned within the cap lateral wall;

the cap base being positioned offset to the holder base;

the pair of pins being radially distributed about the mixing body;

the pair of pins being positioned adjacent to the holder body;

the pair of pins being integrated into the mixing body;

the pair of slots being radially distributed about the cap lateral wall;

the pair of slots being positioned adjacent to the mixing body;

the pair of slots being integrated into the cap lateral wall; and each pin of the pair of pins being slidably engaged with a corresponding slot of the pair of slots.

17. The ready to mix and drink cocktail bottle as claimed in claim 16 comprising:

the pushing rod comprising a first rod end and a second rod end;

the cap lateral wall comprising a first wall edge and a second wall edge;

the first rod end being positioned opposite to the second rod end along the pushing rod;

the first wall edge being positioned opposite to the second wall edge across the cap lateral wall;

the first rod end being connected to the cap base;

the first wall edge being peripherally connected to the cap base; and the second rod end being positioned offset to the second wall edge.

18. The ready to mix and drink cocktail bottle as claimed in claim 13 comprising:

a second coupler;

the second coupler comprising a second coupling protrusion and a second coupling indentation;

the holder lid comprising a lid base, a lid lip, and a rod bumper;

the holder opening comprising an opening lip;

the lid lip being peripherally connected to the lid base;

the opening lip being centrally positioned within the holder opening;

the opening lip being integrated into the holder opening;

the second coupling protrusion being integrated into the lid lip;

the second coupling indentation being integrated into the opening lip;

the second coupling protrusion being engaged with the second coupling indentation;

the rod bumper being positioned adjacent to the lid lip;

the rod bumper being centrally positioned on the lid base;

the rod bumper being mounted onto the lid base; and the rod bumper being positioned within the rod channel.

19. The ready to mix and drink cocktail bottle as claimed in claim 18 comprising:

the holder lid further comprising a plurality of chamber plugs;

the plurality of chamber plugs being positioned adjacent to the lid lip;

the plurality of chamber plugs being radially distributed about the lid base;

the plurality of chamber plugs being mounted onto the lid base; and each of the plurality of chamber plugs being hermetically connected to a corresponding storage chamber of the plurality of storage chambers.

20. The ready to mix and drink cocktail bottle as claimed in claim 13 comprising:

at least one chamber strainer;

the at least one chamber strainer being positioned adjacent to the holder opening; and the at least one chamber strainer being mounted into a storage chamber of the plurality of storage chambers.

* * * * *